US010863841B2

(12) United States Patent
Althaher et al.

(10) Patent No.: US 10,863,841 B2
(45) **Date of Patent: *Dec. 15, 2020**

(54) SPILL PREVENTION SYSTEM FOR DRINKING CUP

(71) Applicants: Ahmed Thaher Althaher, Dhahran (SA); Abdullah Abdulelah Alkharboush, Dhahran (SA)

(72) Inventors: Ahmed Thaher Althaher, Dhahran (SA); Abdullah Abdulelah Alkharboush, Dhahran (SA)

( * ) Notice: Subject to any disclaimer, the term of this patent is extended or adjusted under 35 U.S.C. 154(b) by 16 days.

This patent is subject to a terminal disclaimer.

(21) Appl. No.: 16/245,541

(22) Filed: Jan. 11, 2019

(65) Prior Publication Data

US 2019/0142191 A1 May 16, 2019

Related U.S. Application Data

(63) Continuation of application No. 15/671,489, filed on Aug. 8, 2017, now Pat. No. 10,264,902.
(Continued)

(51) Int. Cl.
*A47G 19/22* (2006.01)
*B65D 41/16* (2006.01)
(Continued)

(52) U.S. Cl.
CPC ..... *A47G 19/2272* (2013.01); *B65D 41/16* (2013.01); *B65D 43/02* (2013.01);
(Continued)

(58) Field of Classification Search
CPC ..... B65D 25/40; B65D 25/48; B65D 41/16; B65D 41/18; B65D 43/065; B65D 43/06;
(Continued)

(56) References Cited

U.S. PATENT DOCUMENTS 4,322,014 A 3/1982 Philip
4,503,992 A 3/1985 Sitko et al.
(Continued)

FOREIGN PATENT DOCUMENTS

DE 20 2015 000 185 U1 3/2015

*Primary Examiner* — Robert J Hicks
(74) *Attorney, Agent, or Firm* — Oblon, McClelland, Maier & Neustadt, L.L.P.

(57) ABSTRACT

A removable lid for a drinking cup is described. The removable lid has a top side with an ellipsoidal recession having a bottom opening. A baffle wall extends from the perimeter of the bottom opening, and is configured to prevent a beverage from passing through the bottom opening upon sudden movement of the beverage. The ellipsoidal recession may be designed so that a hot beverage being consumed through the removable lid is exposed to more outside air for cooling purposes. The same ellipsoidal recession may be designed to funnel added ingredients into a beverage. The removable lid may have a stirrer opening so that stirrers may be inserted and taken out without lid removal. For additional strength, the surface of the removable lid may be textured to increase its moment of inertia. The bottom opening of the removable lid may be closed using a fitted blocking plug.

17 Claims, 13 Drawing Sheets

Related U.S. Application Data

(60) Provisional application No. 62/374,315, filed on Aug. 12, 2016.

(51) Int. Cl.

| | |
|---|---|
| ***B65D 43/02*** | (2006.01) |
| ***B65D 85/72*** | (2006.01) |
| *B65D 47/06* | (2006.01) |
| *B65D 47/32* | (2006.01) |

(52) U.S. Cl.

CPC ..... *B65D 43/0202* (2013.01); *B65D 43/0214* (2013.01); *B65D 85/72* (2013.01); *B65D 47/06* (2013.01); *B65D 47/32* (2013.01); *B65D 2543/00046* (2013.01); *B65D 2543/00092* (2013.01); *B65D 2543/00296* (2013.01); *B65D 2543/00351* (2013.01); *B65D 2543/00388* (2013.01); *B65D 2543/00407* (2013.01); *B65D 2543/00527* (2013.01); *B65D 2543/00537* (2013.01); *B65D 2543/00592* (2013.01); *B65D 2543/00629* (2013.01); *B65D 2543/00685* (2013.01); *B65D 2543/00731* (2013.01); *B65D 2543/00796* (2013.01)

(58) Field of Classification Search

CPC ..... B65D 43/0206; B65D 43/0204; B65D 43/0202; B65D 43/02; B65D 43/22; B65D 43/0214; B65D 47/06; B65D 47/32; B65D 51/1611; B65D 51/1605; B65D 51/16; B65D 45/16; B65D 83/28; B65D 85/72; A47G 19/2272

USPC ..... 220/713, 711, 324, 315, 794, 780, 373, 220/367.1; 229/404, 400; 222/571, 570, 222/567, 566

See application file for complete search history.

(56) References Cited

U.S. PATENT DOCUMENTS

| | | | | |
|---|---|---|---|---|
| 4,574,970 | A | 3/1986 | Schwarz | |
| 4,589,569 | A | 5/1986 | Clements | |
| 4,925,041 | A | 5/1990 | Pehr | |
| 5,820,016 | A | 10/1998 | Stropkay | |
| 5,894,952 | A | 4/1999 | Mendenhall et al. | |
| 6,176,390 | B1 | 1/2001 | Kemp | |
| 6,905,044 | B1 | 6/2005 | Russo et al. | |
| 6,991,128 | B1 | 1/2006 | Russo et al. | |
| 7,134,570 | B1 | 11/2006 | Heath | |
| 7,275,652 | B2 | 10/2007 | Morris et al. | |
| 7,591,393 | B2 | 9/2009 | Crudgington, Jr. | |
| 7,946,752 | B2 | 5/2011 | Swartz et al. | |
| 8,113,379 | B2 | 2/2012 | Cai et al. | |
| 8,172,452 | B2 | 5/2012 | Bacon et al. | |
| 8,313,002 | B2 | 11/2012 | Tokunaga | |
| 8,950,623 | B2 | 2/2015 | Fleming | |
| 9,387,961 | B2 | 7/2016 | Mithal | |
| 2003/0089714 | A1 | 5/2003 | Dart | |
| 2006/0226148 | A1 | 10/2006 | Hundley | |
| 2006/0255038 | A1 | 11/2006 | Hollis | |
| 2007/0056447 | A1 | 3/2007 | Swartz et al. | |
| 2008/0000921 | A1* | 1/2008 | Leon | B65D 43/0204 220/713 |
| 2008/0011762 | A1 | 1/2008 | Boone | |
| 2008/0041862 | A1 | 2/2008 | Bal | |
| 2009/0283535 | A1 | 11/2009 | Mesalic | |
| 2009/0294460 | A1 | 12/2009 | Hovsepian et al. | |
| 2010/0133272 | A1 | 6/2010 | Whitaker et al. | |
| 2015/0014322 | A1 | 1/2015 | Kim | |
| 2016/0264333 | A1 | 9/2016 | Cholhan | |
| 2017/0071379 | A1* | 3/2017 | Savenok | B65D 43/02 |
| 2017/0303713 | A1* | 10/2017 | Fleming | B65D 85/72 |

* cited by examiner

SPILL PREVENTION SYSTEM FOR DRINKING CUP

CROSS-REFERENCE TO RELATED APPLICATIONS

The present application is a Continuation of 15/671,489, now allowed, having a filing date of Aug. 8, 2017, which claims benefit of priority to U.S. provisional application No. 62/374,315 having a filing date of Aug. 12, 2016 and which is incorporated herein by reference in its entirety.

BACKGROUND OF THE INVENTION

Technical Field

The present invention relates to removable lid for a drinking cup.

Description of the Related Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

A large number of people drink hot beverages daily, such as coffee and tea. At home, these beverages are usually consumed from an uncovered mug. While commuting, people may use an insulated traveler mug with a durable, reusable lid, or they may use a disposable cup and lid. The main purpose of these common cup lids for both traveler mugs and disposable cups is to limit spilling and further insulate the beverage. However, these lids have four main disadvantages.

Firstly, consumers risk burning their tongue and lips when drinking hot beverages through a common cup lid. This problem is most frequent with highly-insulated traveler mugs, which contain heat longer, and with the first few sips before a hot beverage cools to a more comfortable temperature. Part of this problem is caused by the unpredictable arrival of hot liquid and steam coming out of the lid's small drink opening. Consumers of beverages in uncovered mugs tend to avoid burning their lips and tongue because the hot beverage is exposed to more air for faster cooling, and the movement of the beverage to the edge of the mug while drinking occurs more predictably with the tilting of the mug.

Secondly, the small size of the drink opening in common cup lids limits the flow of the beverage. In order to drink a larger volume of beverage at once, the consumer must suck on the opening, but the design of some lids makes this uncomfortable, if not impossible, especially with certain reusable lids. This problem does not exist with regular, uncovered mugs where a larger volume of beverage can easily be delivered to a consumer's mouth by tipping the mug at a greater angle.

A third disadvantage is that if a consumer wants to add sugar, milk, or some other powered or liquid ingredient to a beverage contained in a common cup and lid, the consumer must first take the lid off, add the ingredient, stir the beverage with a stirrer, and then reattach the lid. For a consumer in the middle of walking or driving, these steps can be challenging and are even more of a disturbance if he or she does not have something to stir with. Furthermore, some cup lids may break or deform when being removed to add ingredients, and the consumer must then replace the lid with a new one.

A fourth disadvantage of common cup lids is their generally poor spill prevention. While the lids may prevent a large volume of beverage from sloshing out, motion from driving or walking with the cup is sometimes all that it takes for a significant volume of beverage to splash out through the drink opening.

Several cup lid designs have emerged over the past decades to address one of the above disadvantages. However, these designs have mainly been limited to thicker, durable, and reusable cup lids that are not attractive or economical for use in restaurants and café s.

In view of the foregoing, one objective of the present invention is to provide a cup lid with an ellipsoidal recession connected to a bottom opening to provide a wide, exposed beverage flow while drinking and to funnel ingredients to a beverage while leaving the lid secured to the cup. A baffle wall underneath the lid surrounding the drink opening provides further spill prevention.

BRIEF SUMMARY OF THE INVENTION

According to a first aspect, the present disclosure relates to a removable lid for a drinking cup, the removable lid comprising:

a top side with a substantially circular periphery;

a sidewall extending from the periphery; and an annular mounting portion extending from an edge of the sidewall and configured to removably attach to an open side of a drinking cup; and an ellipsoidal recession, located adjacent to the periphery of the top side, with a bottom opening, and a baffle wall connected along a perimeter of the bottom opening and extending away from the top side, wherein the baffle wall is configured to block a beverage from passing through the bottom opening and into the ellipsoidal recession upon a sudden movement of the beverage, wherein the ellipsoidal recession is configured to collect a beverage from the bottom opening prior to consumption, and to allow an ingredient to pass through the bottom opening to a beverage.

In one embodiment, the top side is a generally planar surface forming an angle of 4°-15° with the annular mounting portion so that a height of the sidewall decreases as a distance from the ellipsoidal recession increases.

In one embodiment, the baffle wall forms the sides of a truncated oblique cylinder.

In one embodiment, a central axis of the truncated oblique cylinder intersects a plane circumscribed by the annular mounting portion at an angle of 60°-80°.

In one embodiment, an edge of the truncated oblique cylinder opposite the bottom opening defines a plane that forms an angle of 5°-50° with a plane circumscribed by the annular mounting portion.

In one embodiment, the top side has a generally elliptical periphery with a length to width ratio of 1.03:1-1.10:1.

In one embodiment, the sidewall has a concave curvature near the ellipsoidal recession.

In one embodiment, an intersection of the ellipsoidal recession and the top side forms a generally elliptical shape having a long axis to short axis length ratio of 1.5:1-1.9:1, with the short axis being aligned towards a central region of the top side.

In one embodiment, the removable lid further comprises a curved segment, a beveled segment, or both, between the sidewall and the periphery.

In one embodiment, a central region of the top side has a stirrer opening to accommodate a stirring rod.

In a further embodiment, the removable lid further comprises a sheath extending from an edge of the stirrer opening, the sheath forming an angle of 70°-90° with a plane circumscribed by the annular mounting portion.

In another further embodiment, the stirrer opening is elongated with a length to width ratio of 2:1-10:1.

In one embodiment, the annular mounting portion comprises a bead and a skirt.

In a further embodiment, the skirt is grooved.

In another further embodiment, the annular mounting portion further comprises a liquid trough located between the bead and the sidewall.

In one embodiment, the bottom opening comprises a first edge with a first radius of curvature and a second edge with a second radius of curvature, wherein a ratio of the first radius to the second radius is 1:1.1-1:2.5, and wherein the first edge of the bottom opening is closest to a central region of the top side.

In one embodiment, the removable lid further comprises a vent hole in a region of the top side opposite the ellipsoidal recession.

In one embodiment, the top side has a corrugated surface.

In a further embodiment, the corrugated surface has a plurality of corrugations arranged radially.

In one embodiment, the removable lid further comprises a blocking plug removably attached to the bottom opening, the blocking plug having a handle and is configured to block a beverage from traversing the bottom opening.

The foregoing paragraphs have been provided by way of general introduction, and are not intended to limit the scope of the following claims. The described embodiments, together with further advantages, will be best understood by reference to the following detailed description taken in conjunction with the accompanying drawings.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EMBODIMENTS

Figure 1A:
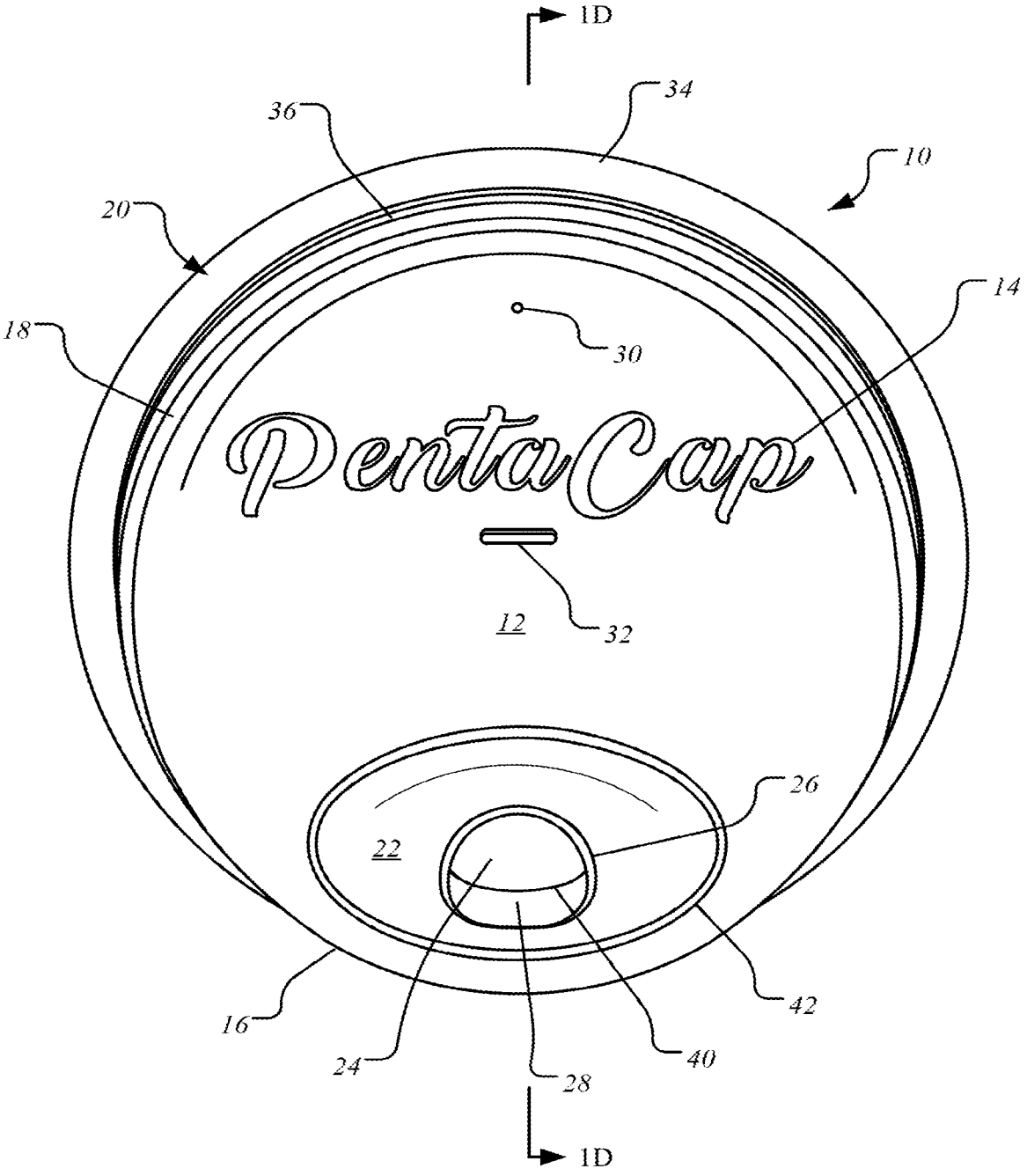
FIG. 1A is an above view of the top side of a removable lid.

Embodiments of the present disclosure will now be described more fully hereinafter with reference to the accompanying drawings, in which some, but not all embodiments of the disclosure are shown. As used herein, the words "a" and "an" and the like carry the meaning of "one or more." Within the description of this disclosure, where a numerical limit or range is stated, the endpoints are included unless stated otherwise. Also, all values and subranges within a numerical limit or range are specifically included as if explicitly written out. For convenience of description, directional terms such as "down," "horizontally," "vertically," etc. refer to the orientation of the lid as in FIG. 5.

According to a first aspect, the present disclosure relates to a removable lid 10 for a drinking cup 52. The removable lid 10 has a top side 12 with a substantially circular periphery 16, a sidewall 18 extending from that periphery, and an annular mounting portion 20 extending from an edge of the sidewall and configured to removably attach to an open side of a drinking cup 52. The top side 12 adjacent to the periphery 16 has an ellipsoidal recession 22 with a bottom opening 24, and a baffle wall 28 connected along a perimeter 26 of the bottom opening and extending away from the top side 12. The ellipsoidal recession 22 is configured to collect a beverage from the bottom opening 24 prior to consumption, and is also configured to allow an ingredient to pass through the bottom opening 24 to a beverage 62. The baffle wall 28 is configured to block a beverage from passing through the bottom opening 24 and into the ellipsoidal recession 22 upon a sudden movement of the beverage 62.

In one embodiment, the lid 10 may comprise a polymeric material such as acrylic, nylon, polyurethane, melamine, polytetrafluoroethylene, polypropylene, polyetheretherketone, polyethylene, polycarbonate, polystyrene, or some other food grade plastic. Preferably, the polymeric material is heat stable against hot beverages, meaning that up to temperatures of 110° C., the lid does not degrade and does not deform to an extent that limits its function. In another embodiment, the polymeric material does not degrade or deform when covering a beverage being microwaved. Additionally, where the lid 10 comprises a thermoplastic polymer, the lid may be formed by press forming, injection molding, vacuum forming, thermoforming, blow molding, rotational molding, 3D printing, or some other fabrication method. In other embodiments, the lid 10 may comprise stainless steel, glass, ceramic, aluminum, silicone, paper, a thermochromic dye, or other materials. In one embodiment, the lid 10 may be recyclable and/or compostable. Where the lid 10 is intended for reuse, the lid may have a sidewall thickness of 0.4-3 mm, preferably 0.5-2.5 mm, more preferably 0.8-2 mm, and the sidewall thickness may vary at different locations of the lid, for instance, the baffle wall 28 may have a sidewall thickness that is less than the sidewall thickness of the top side 12 of the lid. Where the lid 10 is formed for single-use, the sidewall may have a thickness of 0.05-1.0 mm, preferably 0.1-0.6 mm, more preferably 0.2-0.5 mm. The general size of the lid 10 may vary based on the dimensions of the cup 52. For instance, the lid may be manufactured with different sizes or dimensions tailored to match with a cup having a particular size and shape.

Figure 1B:
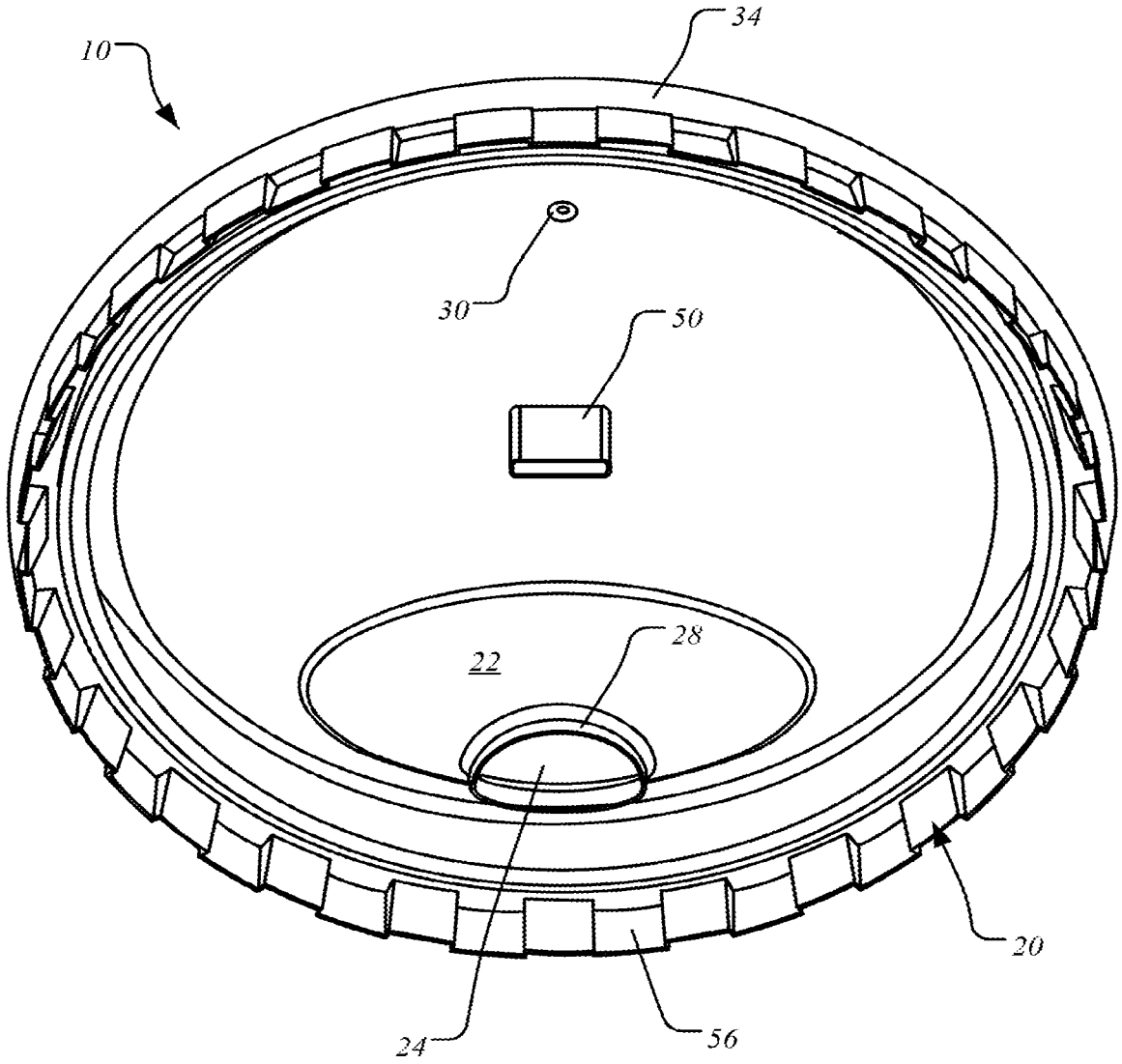
FIG. 1B is a bottom view of the removable lid.
Figure 1C:
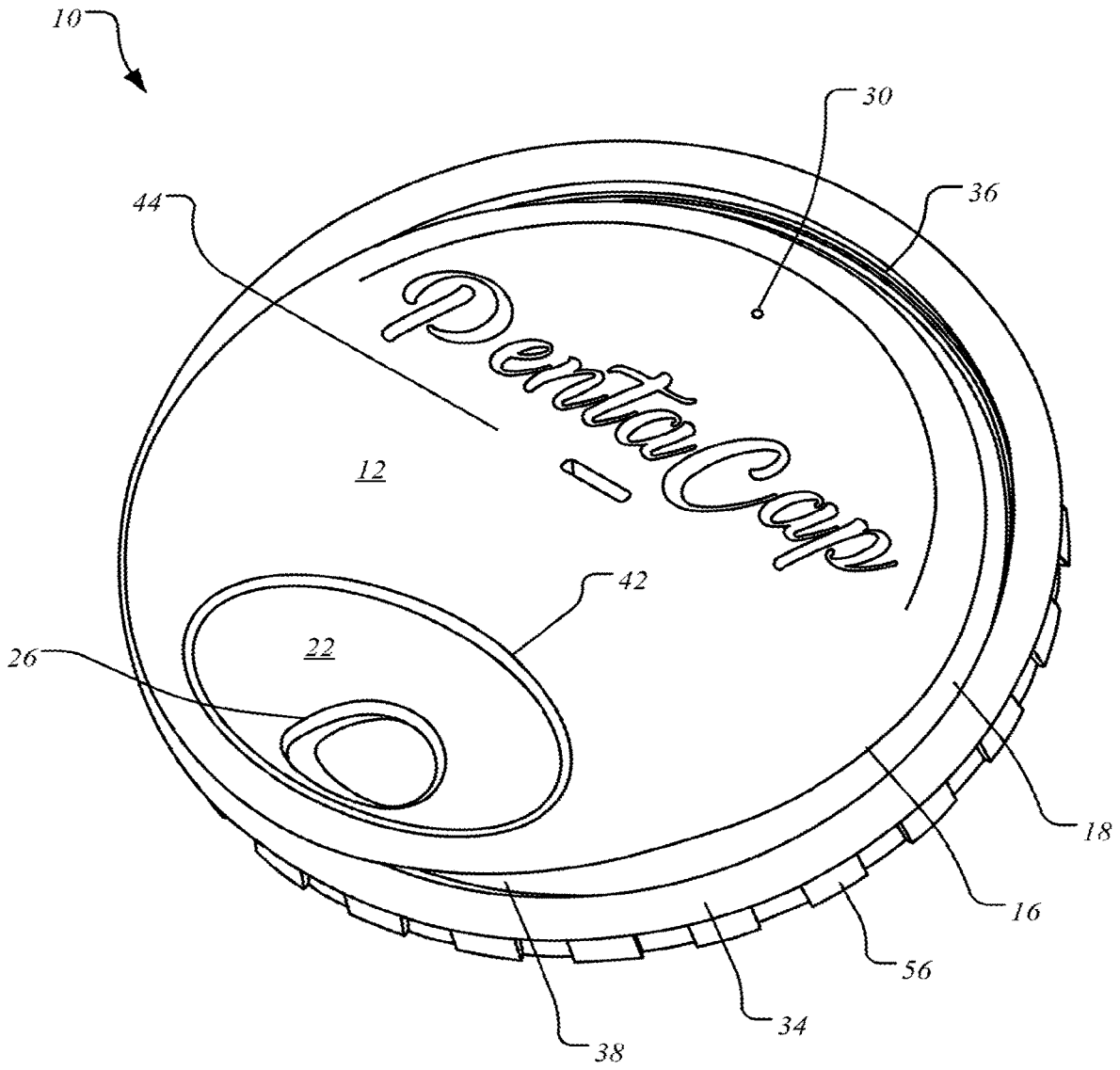
FIG. 1C is an angled view of the removable lid.
Figure 1D:
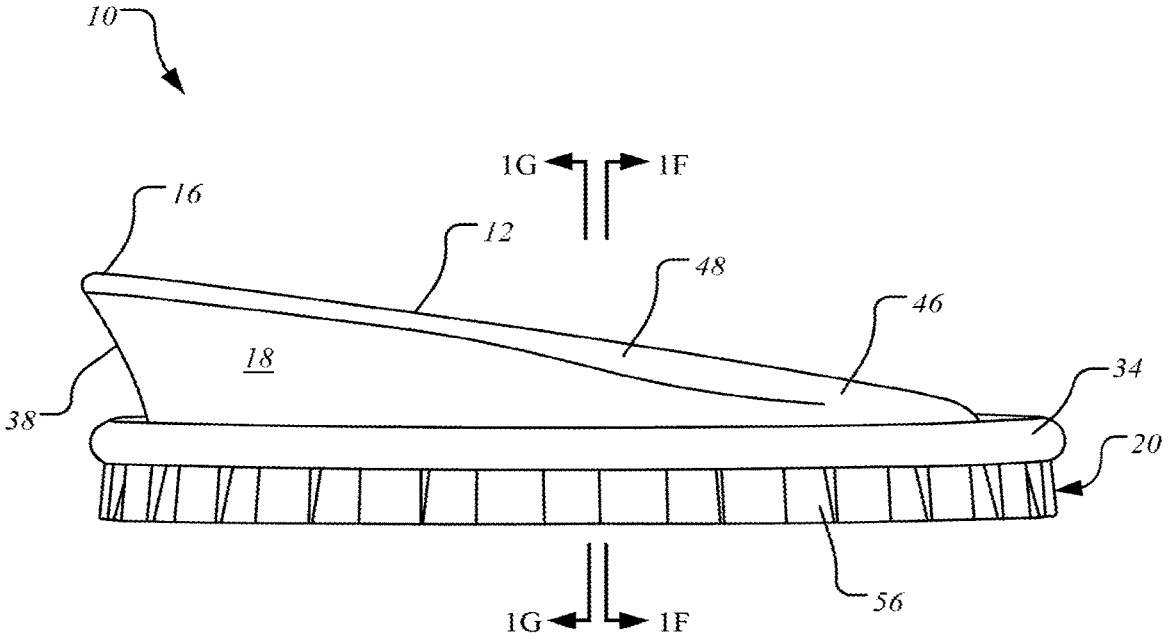
FIG. 1D is a side view of the removable lid.

In one embodiment, the top side 12 of the lid is a generally planar surface, where the term "generally planar" refers to height variations along any given section of the surface (e.g., sections about 10 mm in diameter) being reduced to about 5 mm or less. However, in a preferred embodiment, the top side 12 forms an angle of 4°-15°, preferably 6°-13°, more preferably 8°-12° with a plane circumscribed by the annular mounting portion 20 so that a height of the sidewall 18 decreases as a distance from the ellipsoidal recession 22 increases. This embodiment is illustrated in FIG. 1D. This angle of the top side may better accommodate the nose of a consumer who is drinking through the lid 10. The central region 44 of the top side describes an area of the top side 12 that is 10%-50%, preferably 20%-40%, more preferably 25%-35% of the total top side area and that is located farthest from the periphery 16. Preferably, the central region 44 includes the centroid (also known as the geometric center) of the top side 12. Alternatively, in one embodiment, the top side 12 is parallel with a plane circumscribed by the annular mounting portion 20. This may allow the top side 12 of a lid to hold an object without it sliding off, for instance, a napkin, a sugar packet, or a small container of liquid creamer (e.g. 8-10 mL).

In one embodiment, the top side 12 of the lid has a corrugated surface, which may also be considered a ribbed or grooved surface. Here the corrugations 64 may be parallel with a fixed cross-section having a periodic pattern, such as a square wave, a triangle wave, or a sine wave, or may have peaks and valleys in different shapes. In one embodiment, the corrugations 64 may have rectangular shapes, with the peaks and/or valleys having widths of 0.5-7 mm, preferably 0.8-5 mm, more preferably 1.0-3.0 mm, and heights of 0.4-4.0 mm, preferably 0.5-3.0 mm, more preferably 0.6-1.5 mm. Preferably, the corrugations 64 provide resistance against deformation of the top side 12, compared to a lid that does not have corrugations on the top side 12. In one embodiment, the corrugations 64 increase the second moment of area (also known as the moment of inertia of plane area), which strengthens the lid 10. In one embodiment, the wall thickness of the top side 12 may be similar to the wall thickness of a top side 12 without corrugations, though in another embodiment, the wall thickness may be greater or smaller. In one embodiment, the reverse side of the top side (i.e. the beverage-facing side) may also be corrugated, though in other embodiments the reverse side may be smooth. In an alternative embodiment, the wall of the top side may be thickened to increase its strength without adding corrugations.

Figure 6A:
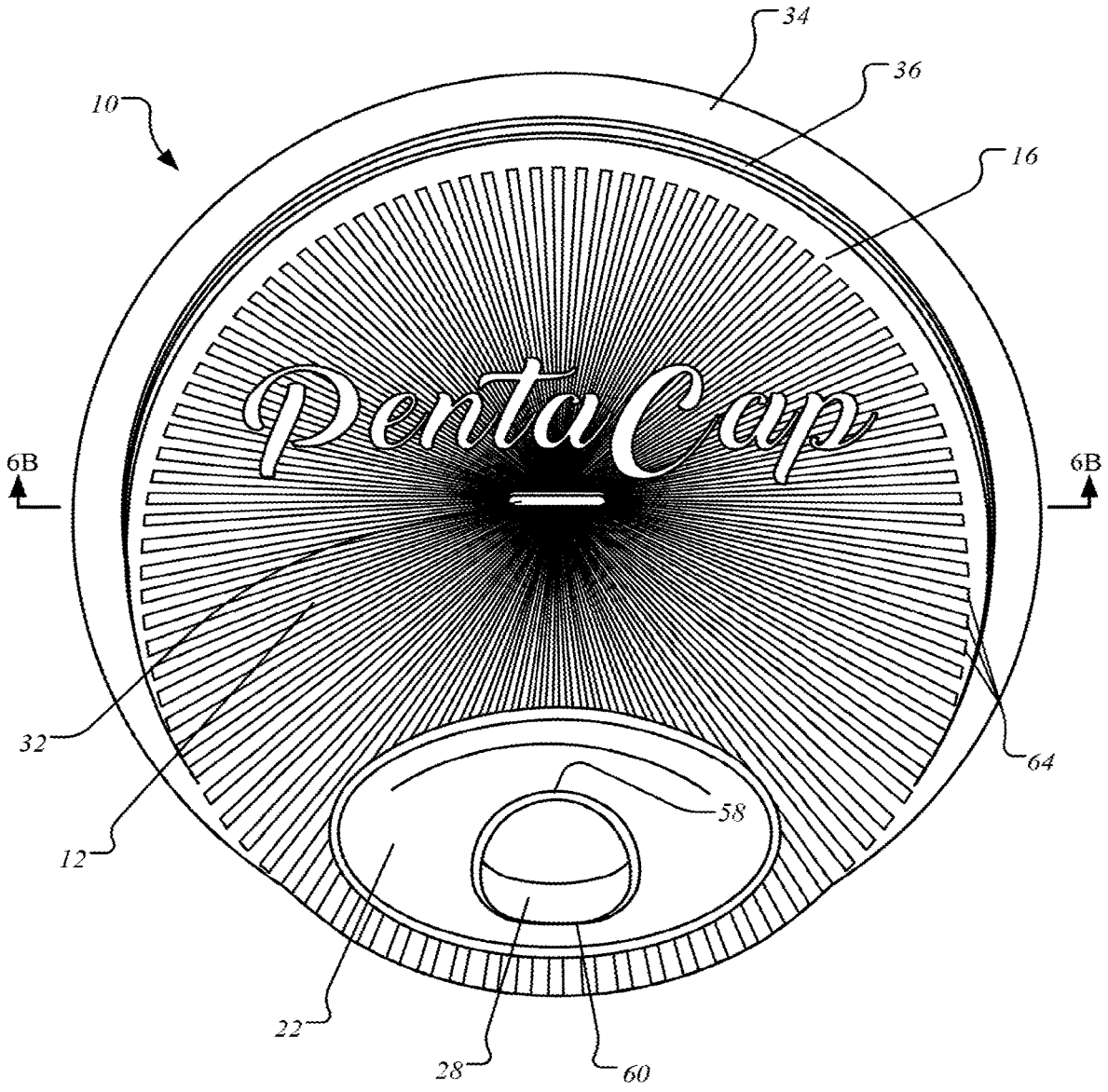
FIG. 6A is an above view of the top side of a removable lid having radial corrugations.
Figure 6B:
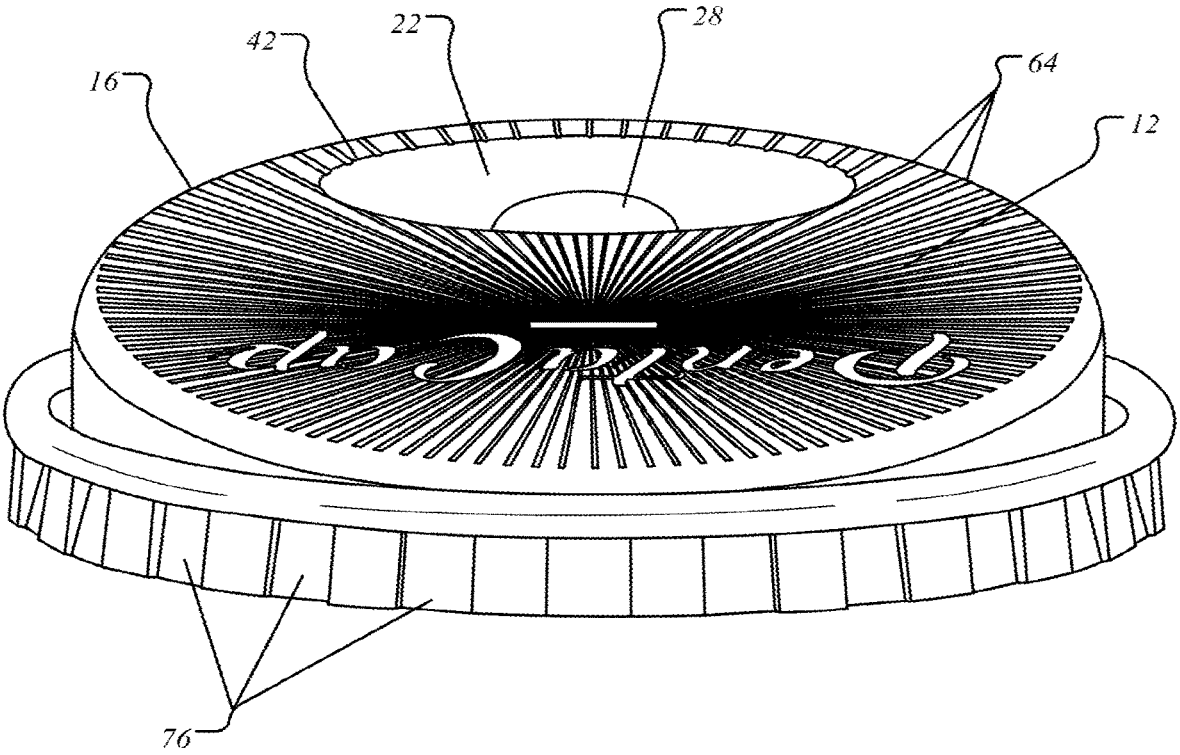
FIG. 6B is a side view of the removable lid in FIG. 6A.

In a further embodiment, the top side 12 of the lid 10 may have a plurality of corrugations, grooves, or ribs arranged radially. Preferably the corrugations 64, grooves, or ribs extend radially from the stirrer opening or from within a central region 44 of the top side. FIGS. 6A and 6B show corrugations 64 arranged radially from the stirrer opening 32. Where the top side 12 has corrugations 64, grooves, ribs, or some other linear form arranged radially, the nearest two linear forms may form an angle of 1.5°-6°, preferably 2°-5°, more preferably 3°-4.5°, and may have the same angle throughout or different angles.

In one embodiment, 100% of the top side 12 is corrugated, ribbed, or grooved, though in another embodiment, 50-95%, preferably 60-90%, more preferably 70-85% of the top side 12 is corrugated, ribbed, or grooved, in terms of a total surface area of the top side. In one embodiment, a logo 14, brand, or image may be formed by specifically excluding corrugations, ribs, or grooves from certain parts of the top side. An example of this is shown with the logo 14 in FIG. 6A. In another embodiment, the top side 12 may be formed with one or more deformable buttons that may be pressed in or deformed to identify a beverage or an added ingredient.

In one embodiment, the top side 12 of the removable lid 10 has a substantially circular periphery 16 where the ratio of its major axis (or length) to its minor axis (or width) is 1.00:1-1.10:1, preferably 1.00:1-1.08:1, more preferably 1.00:1-1.075:1. In one embodiment, the substantially circular periphery 16 is circular, with a 1:1 length to width ratio.

As used herein, "substantially circular periphery" refers to a rounded shape with at least one-fold reflection symmetry. The periphery 16 may have the shape of an ellipse, a circle, an oval, an egg, or may be a combination of elliptical curves, circular curves, Bezier curves, parabolic curves, a cycloid, or some other curve. For example, one half of the periphery may be a semicircle, while the other half may be a semi-ellipse. In one embodiment, the substantially circular periphery 16 is generally elliptical, where the ratio of its major axis (or length) to its minor axis (or width) is 1.03:1-1.10:1, preferably 1.04:1-1.08:1, more preferably 1.06:1-1.075:1. FIG. 1A shows a removable lid 10 with a generally elliptical periphery 16. In an alternative embodiment, the periphery 16 may have one or more straight edges, or straight edges connected by rounded corners, or the periphery 16 may have no reflection symmetry. Preferably the periphery 16 is a convex shape, though in an alternative embodiment, the periphery may be non-convex.

Figure 1E:
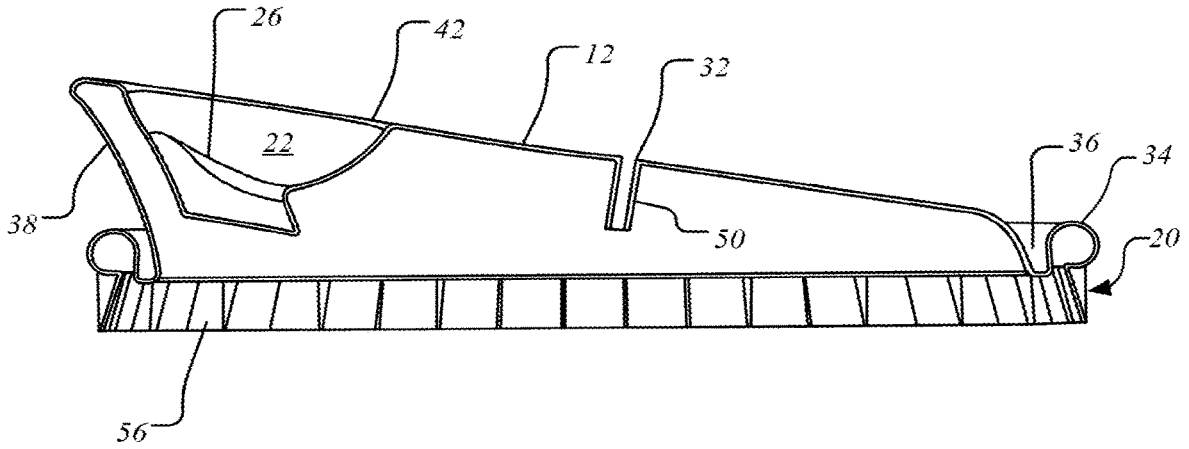
FIG. 1E is a cross-section view of FIG. 1D.
Figure 1F:
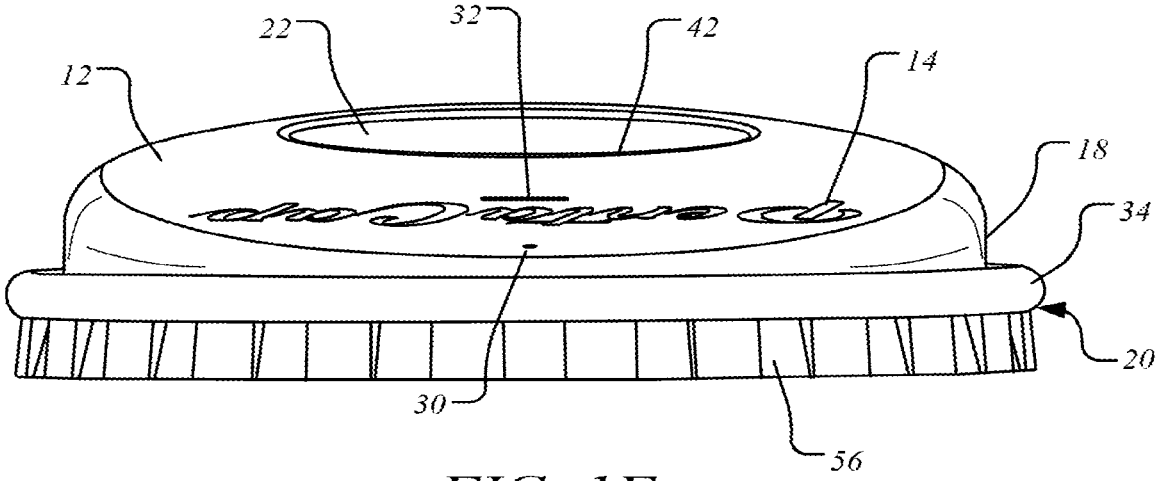
FIG. 1F is a side view of the removable lid from the side near the vent hole.

The width and/or the length of the top side 12 may be 4-13 cm, preferably 6-11 cm, more preferably 6.5-10 cm. The top side 12 of the lid has a sidewall 18 extending from the periphery 16 and ending with an annular mounting portion 20 configured to attach to an open side of a drinking cup 52. This sidewall 18 may have a height of 0.8-3.0 cm, preferably 1.0-2.5 cm, more preferably 1.2-1.8 cm. The sidewall 18 may have straight sides that are substantially perpendicular to the plane of the annular mounting portion 20. These substantially perpendicular sidewalls are evident in FIGS. 1F and 1G. In one embodiment, a portion or all of the sidewall 18 may be frustoconical in shape, with sides angled down and away from a central region 44 of the top side of the removable lid, forming an angle between the sidewall 18 and the top side 12 that may be between 90° and 155°, preferably between 90° and 135°, more preferably between 90° and 110°. In another embodiment, the sidewall 18 may have a concave curvature 38 as in FIG. 2, or the sidewall may extend up and away from the annular mounting portion 20 at an angle.

Figure 4:
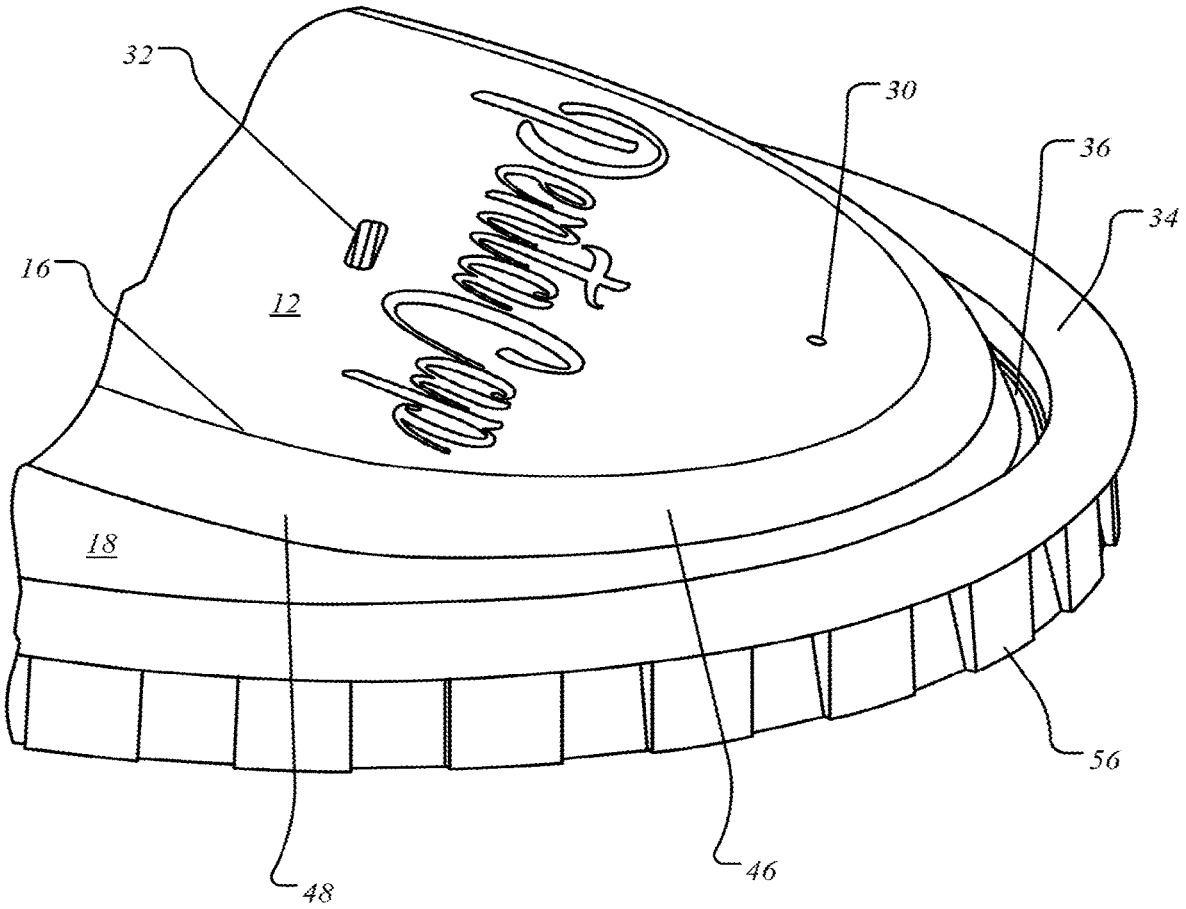
FIG. 4 is an angled view of the removable lid showing a beveled segment and a curved segment between the sidewall and the periphery.

In one embodiment, the removable lid has a curved segment 46, a beveled segment 48, or both, between the sidewall 18 and the periphery 16. These segments may have widths of 1-15 mm, preferably 2-8 mm, more preferably 3-6 mm and lengths of 0.5-9 cm, preferably 0.8-5 cm, more preferably 1-3 cm. FIGS. 1D and 4 show that the sidewall 18 and the top side 12 meet at the periphery 16 and share the same edge near the concave curvature 38. Moving away from the concave curvature 38, the edge becomes a beveled segment 48 and then a curved segment 46. In one embodiment, a removable lid may have one or more beveled segments without a curved segment, or one or more curved segments without a beveled segment. In one embodiment, a curved segment 46 as in FIGS. 1D and 4 may assist removing a thermoformed lid from a mold during fabrication. In related embodiments, the sidewall 18 may have grooves, ribs, channels, textures, or embossed logos.

In one embodiment, a liquid trough 36 exists between the sidewall 18 and the annular mounting portion 20 in order to collect stray liquid from a beverage. This trough 36 may have a depth of 1-5 mm, preferably 1.5-4 mm, more preferably 1.8-3 mm and a width of 2-6 mm, preferably 2.2-4 mm, more preferably 2.5-3 mm. In an alternative embodiment, the trough 36 may not encircle the entire removable lid 10 but may be positioned near the ellipsoidal recession 22. In another embodiment, a liquid trough 36 may have a hole to allow stray liquid from a beverage to drain back into a cup.

The annular mounting portion 20 may be in a form to fasten over a beaded lip of a cup, for instance, the beaded lip of a paper cup for hot or cold beverages. To elaborate, the annular mounting portion 20 may have a bead 34 in a form complimentary to the beaded lip of a cup, and may be able snap over and fasten to a cup. The bead 34 may have a width of 1-10 mm, preferably 2-7 mm, more preferably 2.5-5 mm. In one embodiment, the bead 34 of the annular mounting portion 20 may be formed to fit over the straight edges of a cup rather than a beaded lip. In particular, this may be a cup made of expanded or extruded foam, such as closed-cell extruded polystyrene foam (e.g. STYROFOAM). A removable lid 10 designed to attach to a cup of malleable material (such as expanded or extruded foam) may have a bead 34 with interior ribs or raised points that slightly deform the lip of the cup but provide a stronger grip. In a preferred embodiment, the lid 10 attaches onto the cup strongly enough that a cup 52 and lid 10 assembly containing a beverage 62 may be tilted or inverted without the weight of the beverage loosening or removing the lid 10. However, it is also preferred that an attached lid is manually removable without tools required. In an alternative embodiment, the lid may be secured to the open side of a cup with an adhesive.

Figure 1G:
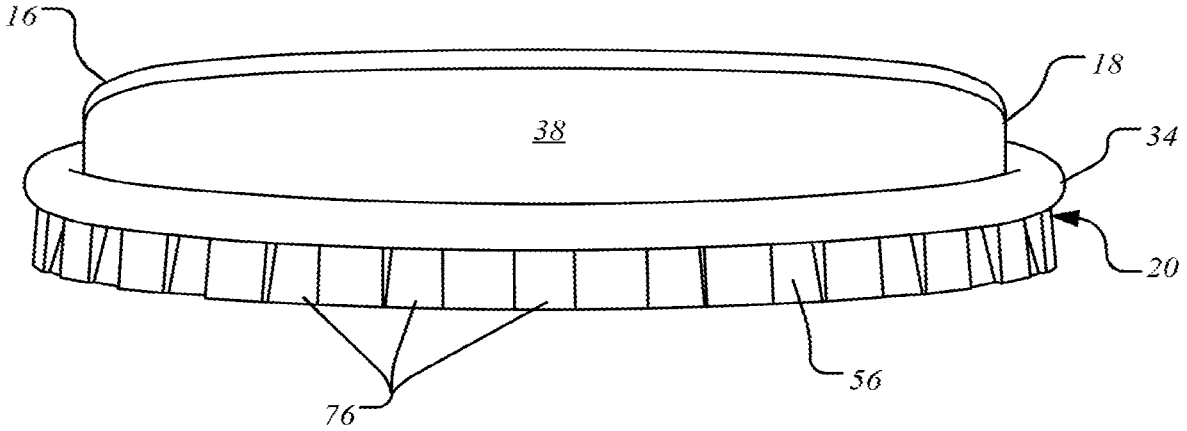
FIG. 1G is a side view of the removable lid from a side near the concave curvature.
Figure 2:
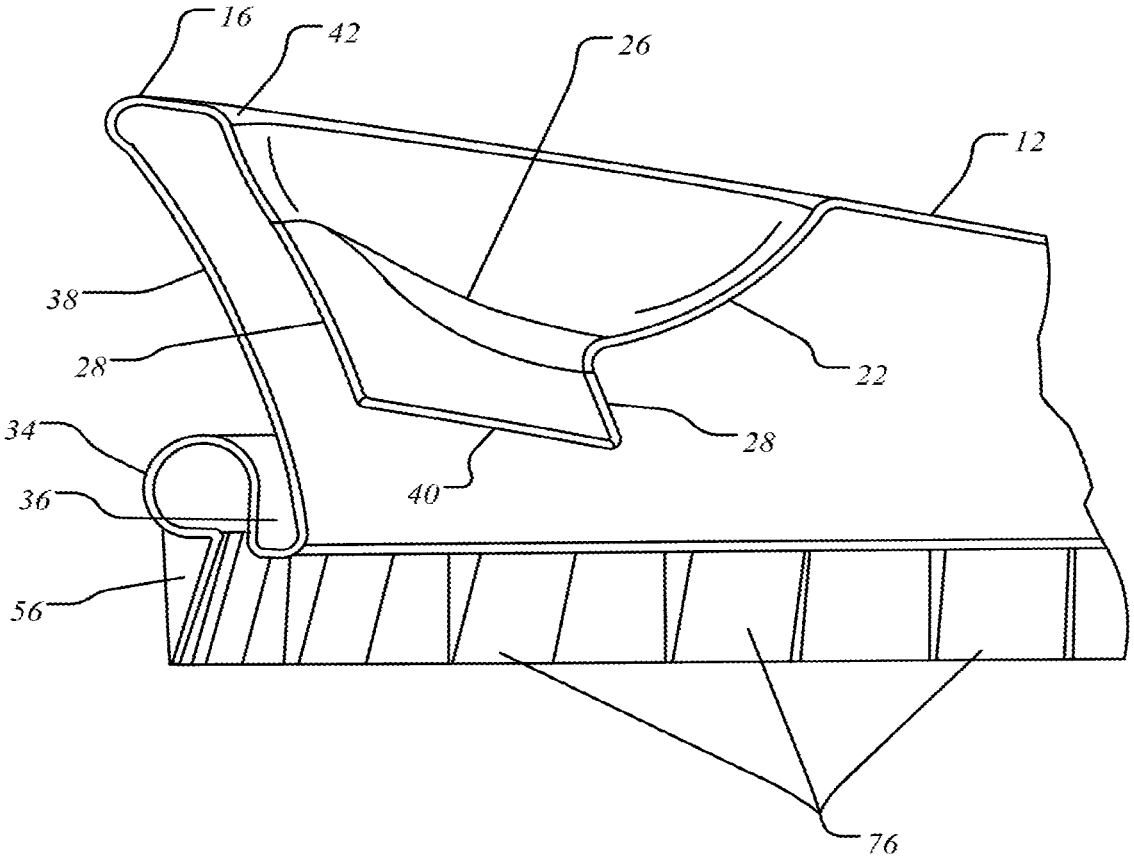
FIG. 2 is a close-up view of the ellipsoidal recession as in FIG. 1E.
Figure 8:
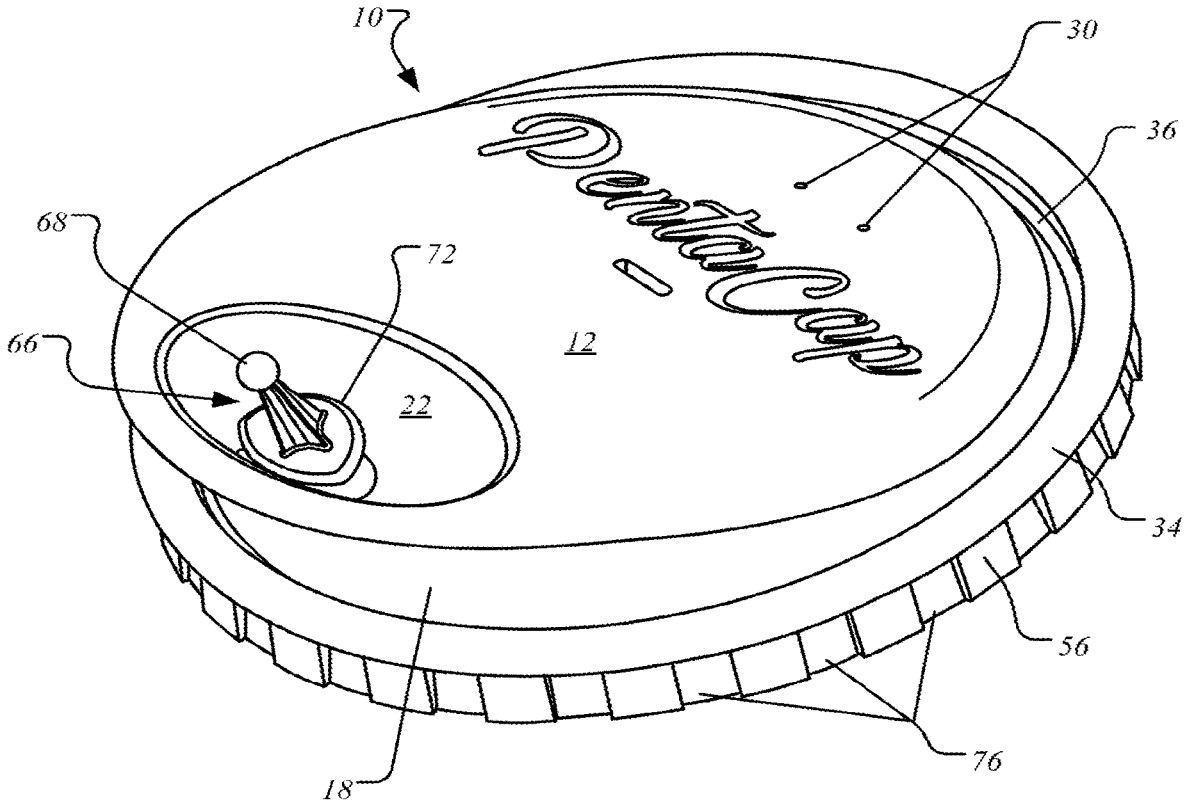
FIG. 8 is an angled view of a removable lid configured with a blocking plug in the bottom opening.

The bottom edge of the annular mounting portion 20 may comprise a skirt 56 to direct and center the lid 10 as it is being attached to the top of a cup. The skirt 56 may be flared or curved and may also assist in providing a finger grip for someone to lift and remove a fastened lid, or may assist in providing a finger grip for someone separating a stack of lids that are nested together. In one embodiment, the skirt 56 may be grooved, ribbed, fluted, corrugated, pleated, knurled, or may be formed with some other texture. FIGS. 1G and 2 show removable lids where the skirt 56 of the annular mounting portion 20 has grooves 76. Here, the grooves comprise alternating square shapes that have sides approximately equal to the height of the skirt, and are spaced by similar square shapes. Alternatively, the skirt may have grooves spaced by 0.5-10 mm, preferably 0.7-7 mm, more preferably 0.8-5 mm, and these groves may be present along the whole height of the skirt or only a portion of the skirt. A skirt with grooves or some other texture may provide a grip for a person twisting a fastened lid, or may assist in removing a thermoformed lid from a mold. FIG. 8 shows a removable lid 10 having a skirt 56 with grooves 76. In an alternative embodiment, the annular mounting portion 20 may comprise threads in order to screw onto the top of a cup having complementary threads. In one embodiment, the outer diameter of the annular mounting portion 20 may be smaller than the inner diameter of the cup, so that the annular mounting portion 20 fits inside a cup. In that embodiment, the annular mounting portion 20 may comprise one or more gaskets made of an elastomeric material such as latex, nitrile, or silicone, in order to both secure the lid within the cup opening and to seal the edges of the lid against leaks. In another embodiment, the lid and/or cup may have latches or clasps that may be moved into a position to secure the lid.

Figure 5:
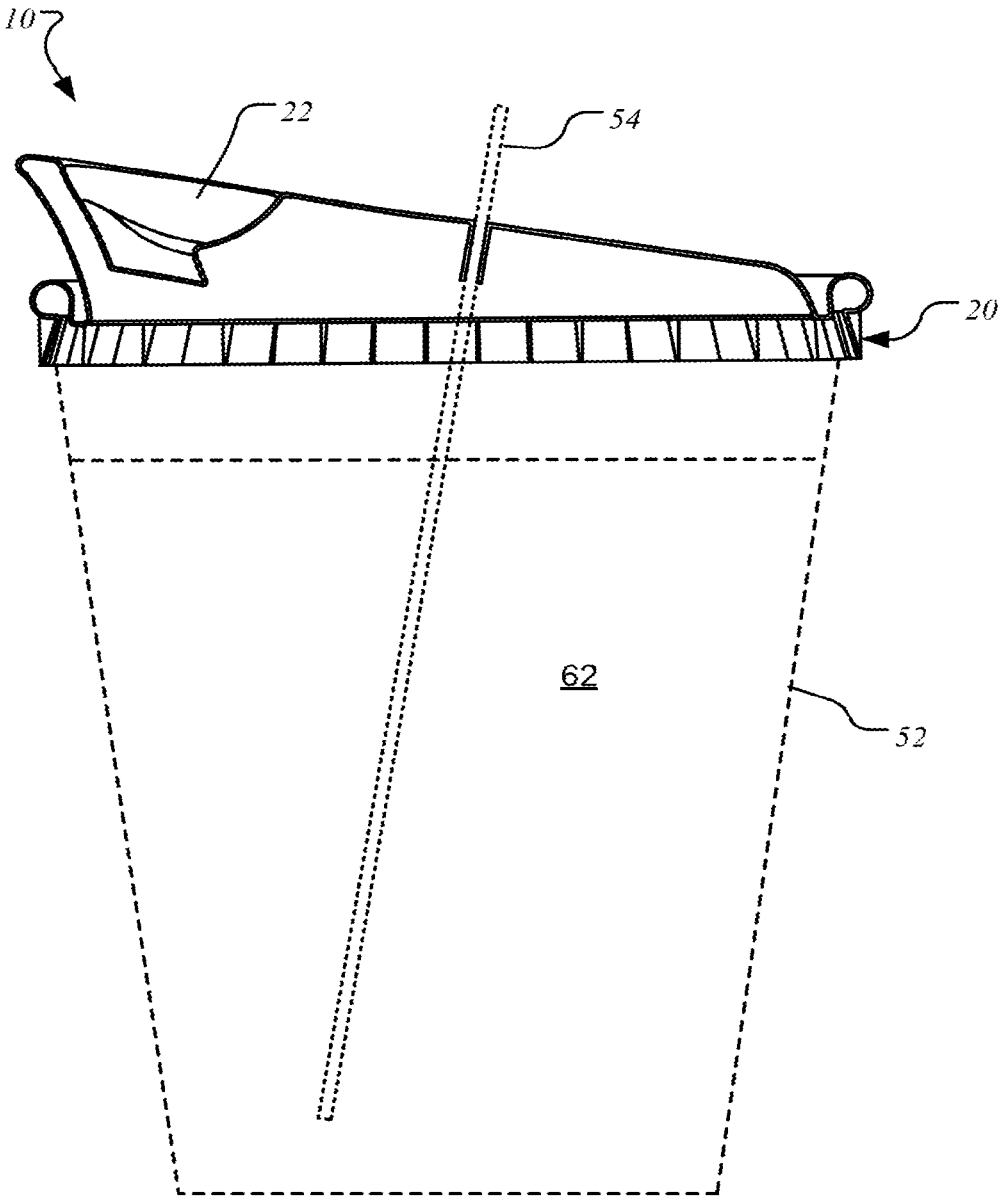
FIG. 5 is a side view of the removable lid showing a configuration with a cup and a stirring rod.

FIG. 5 shows a configuration of the removable lid 10 with a stirring rod 54, the lid being on a drinking cup 52 holding a beverage 62. The drinking cup 52 may be reusable, and may comprise materials such as stainless steel, glass, ceramic, aluminum, iron, wood, silver, copper, acrylic, nylon, polyurethane, melamine, polytetrafluoroethylene, polypropylene, polyetheretherketone, polyethylene, polycarbonate, polystyrene, or some other food grade material. A lid 10 may be reused with different cups and/or different beverages, and may be washed or rinsed between uses. The cup 52 may have a total capacity of 25 mL-3 L, preferably 100 mL-2 L, more preferably 150 mL-1.2 L, and a height of 3-30 cm, preferably 9-20 cm, more preferably 10-17 cm. Preferably the top of the cup has a similar diameter to the annular mounting portion 20. In an alternative embodiment, a lid with a non-circular mounting portion may be used on a cup with a non-circular opening, for instance, a cup having an elliptical or a rounded rectangular opening. In other embodiments, the drinking cup 52 may be disposable, comprising materials such as paper, polystyrene (including STYROFOAM), polyethylene terephthalate, poly(lactic-co-glycolic acid), polycarbonate, ceramic, or some other material such as those mentioned previously. A paper cup may be lined with wax or a polymeric material such as polylactic acid. The drinking cup 52 may be insulated with a double wall, a second cup, a sleeve, or some other insulating material, or the cup may be uninsulated. The drinking cup 52 may be designed specifically for hot beverages and/or cold beverages. The drinking cup 52 may hold other flowable substances that may have viscosities or consistencies different that coffee or tea, such as shakes, ices, slushes, yogurt, porridge, glaze, pudding, gelatin, steamed milk foam, whipped cream, and/or soup. Alternatively, the cup 52 may hold substances that are not beverages, such as cleaning solutions, dry ice, solvents, or other liquids. In one embodiment, the vertical height of the sidewall 18 and the angle of the top side 12 with the annular mounting portion 20 allow a headspace above a beverage 52 for ice, steamed milk foam, or whipped cream. In one embodiment, the removable lid 10 may comprise a transparent or translucent material in order for a consumer to see the level of a beverage 62 or to see beverage toppings such as whipped cream or caramel.

In one embodiment, the top side 12 of the lid has an ellipsoidal recession 22 proximal to the periphery 16, by a distance of 1-3 mm, preferably 1.5-2.5 mm. In one embodiment, the intersection 42 of the ellipsoidal recession and the top side forms a generally elliptical shape having a long axis to short axis length ratio of 1.5:1-1.9:1, preferably 1.6:1-1.8:1, more preferably 1.65:1-1.75:1. This intersection 42 is also referred herein as the top edge of the ellipsoidal recession. Preferably, the short axis of the ellipsoidal recession 22 is aligned towards a central region 44 of the top side 12, as is shown in FIG. 1C. Preferably the area enclosed by the top edge 42 of the ellipsoidal recession is equal to or less than 50%, preferably less than 40%, more preferably less than 30% of the area enclosed by the periphery 16.

In one embodiment, the top edge 42 of the recession may be circular, or some other rounded shape such as those discussed previously for the periphery 16 of the top side. Alternatively, the top edge may be a polygon, such as a triangle or rectangle, or may be a combination of curved and straight edges. For example, the top edge may be in the form of a semicircle, with the curved edge located along the periphery 16. In one embodiment, as shown in FIG. 1C, part of the top edge 42 of the ellipsoidal recession 22 coincides with or is proximal to a part of the periphery 16 to form a rim from which a consumer can drink a beverage. Where the rim is present, the rim may have a width of 1-3 mm, preferably 1.5-2.5 mm.

In one embodiment, the ellipsoidal recession 22 may extend outward and away from the sidewall 18 by at least 2 mm, preferably at least 3 mm, more preferably at least 4 mm. In this embodiment, the extending part of sidewall may have a concave curvature 38, and may be configured to the shape of a consumer's lower lip. This concave curvature 38 is visible in FIGS. 1D, 1E, and 2. The curve may be circular, catenary, parabolic, a spline, a Bézier curve, or some other curve, and may vary in shape closer or farther from the recession. In one embodiment, the curve approximates a circular curvature having a radius of 5-15 cm, preferably 7-12 cm, more preferably 8-11 cm. In one alternative embodiment, the entire sidewall 18 may be curved inwards, preferably by the same amount to create rotational symmetry, similar to a vase or a drinking glass with a flared lip. Alternatively, the sidewall may be curved outwards, may comprise annular bevels or indentations, or may be extended at an angle without a curve. In another embodiment, the sidewall 18 may have a concave curvature 38 without the ellipsoidal recession 22 extending beyond the annular mounting portion 20.

In an alternative embodiment, the recession may not necessarily be an ellipsoidal recession. In one embodiment, the interior of the recession is curved. Preferably, where the top edge 42 of the recession is elliptical, the interior of the recession is ellipsoidal in shape. Similarly, where the top edge is circular, the interior of the recession may be spherical, such as a hemisphere. In an alternative embodiment, the recession may comprise straight edges and a flat bottom, for instance, a recession that has a circular top edge may have a cylindrical shape. Where the interior of the recession comprises straight edges, the edges may be vertical and perpendicular to the plane of the top edge of the recession, or the edges may form acute or obtuse angles. The depth of the recession, being an ellipsoidal recession 22 or some other shape, may be 0.8-3.0 cm, preferably 1.0-2.5 cm, more preferably 1.2-1.8 cm. Preferably, the depth is equal to or less than the height of the sidewall 18, though in an alternative embodiment, the depth of the recession is greater.

In one embodiment, the ellipsoidal recession 22 comprises a bottom opening 24 configured to be in fluid communication with an enclosed beverage 62. Preferably the bottom opening 24 contains or is adjacent to the lowest part of the ellipsoidal recession 22, though in an alternative embodiment, the bottom opening 24 may be located on a side of the ellipsoidal recession 22. In one embodiment, the bottom opening 24 coincides with the lowest part of the ellipsoidal recession 22 without being centered around the lowest point. This arrangement is shown in FIG. 2, where the perimeter 26 of the bottom opening is off-center with regards to the ellipsoidal recession 22, but the perimeter still coincides with the lowest part, thus allowing stray liquids or ingredients to drain back into the cup. In another alternative embodiment, the ellipsoidal recession 22 may comprise more than one opening. In one embodiment, the perimeter 26 of the bottom opening encloses a smaller area than that enclosed by the top edge 42 of the ellipsoidal recession, which area may be less than 80%, preferably less than 70%, more preferably less than 65% of the area enclosed by the top edge 42, though in an alternative embodiment, the areas are equal. The bottom opening 24 may comprise a shape similar to, or as shape scaled down from, the shape enclosed by the top edge 42, or may be in a different shape. In a preferred embodiment, the bottom opening 24 is in a shape with smoothed edges and is configured to a size that simultaneously allows air to enter the cup 52 and beverage 62 to exit at normal drinking rates. Preferably the bottom opening 24 is large enough to allow flow rates comparable to an uncovered mug when tilted at an angle for drinking. The bottom opening 24 may furthermore be large enough to accommodate a drinking straw, for example a drinking straw having a diameter of 3 mm-15 mm, or 4-6 mm. In a preferred embodiment, the bottom opening 24 is configured to deliver a flow of a beverage 62 from the cup 52 into the ellipsoidal recession 22, where the beverage is momentarily exposed to the open air outside the cup before entering the mouth of a consumer. In this sense, the ellipsoidal recession 22 may be thought of as a "mini-cup" within the lid 10. Allowing exposure to open air may cool a hot beverage to a temperature that is less likely to scald the mouth, lips, or tongue of the consumer. The exposure to open air may also allow a beverage to emit aroma and/or vapor before entering the consumer's mouth, creating a sensory experience similar to drinking with an uncovered mug.

Figure 3:
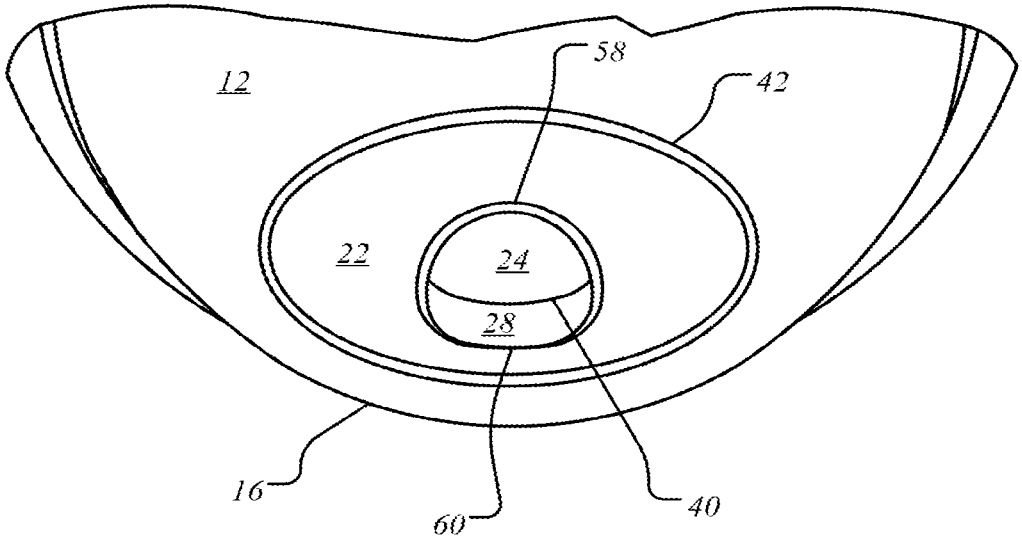
FIG. 3 is a close-up view of the ellipsoidal recession as in FIG. 1A.

In one embodiment, the bottom opening 24 comprises a first edge 58 with a first radius of curvature and a second edge 60 with a second radius of curvature. Preferably, the edge of the bottom opening having the larger radius of curvature (i.e. a flatter curve) is closest to the periphery 16, and the edge having the smaller radius of curvature is closest to a central region 44 of the top side. The first radius of curvature may be 0.5-2 cm, preferably 0.8-1.9 cm, more preferably 1.1-1.8 cm. The second radius of curvature may be 2.1-7 cm, preferably 2.2-5 cm, more preferably 3-4.5 cm. The ratio of the first radius to the second radius may be 1:1.1-1:2.5, preferably 1:1.2-1:2.4, more preferably 1:1.5-1:2.0, with the first edge 58 of the bottom opening closest to a central region 44 of the top side. FIG. 3 shows a close up view of this embodiment with the bottom opening 24 comprising a first edge 58 and a second edge 60. In one embodiment, the bottom opening 24 may comprise edges having more than two different radii of curvature, or may comprise two or more edges that have the same curvature. In one embodiment, the bottom opening 24 is a rounded shape with more than one radius of curvature. In one embodiment, the bottom opening 24 may be similar to a Reuleaux triangle but with smoothed points. In another embodiment, the bottom opening 24 may be similar to a hyperbolic triangle. In another embodiment, the bottom opening 24 may be in any other shape that enhances collecting the flowing beverage into a central line of the recession 22. The purpose of these shapes is to allow a wider surface area for the beverage in its initial contact with the bottom opening 24 and thinner surface area at the periphery 16. In other words, the shape of the recession 22 takes a stream of beverage having a relatively low exposure to ambient air as it exits the cup 52 through the bottom opening 24 and shapes it into a stream having a higher exposure to ambient air as it reaches the periphery 16.

Additionally, in a preferred embodiment, the ellipsoidal recession 22 is configured to act as a funnel to collect an added ingredient and direct it to the bottom opening 24 where it can fall to the surface of the beverage 62. Similarly, a liquid that has splashed from the beverage 62 may be directed back into the cup 52. The added ingredient may be a powdered solid including, but not limited to, table sugar, glucose, fructose, sugar substitute, powdered creamer, cinnamon, nutmeg, vanilla sugar, powdered ginger, cocoa powder, whey powder, milk powder, gelatin powder, cornstarch, instant coffee, instant tea, vitamins and/or dietery minerals. In one embodiment, the ellipsoidal recession 22 may better accommodate powdered solids added from elongated "stick packets," rather than rectangular packets having wider sides. In some embodiments, the size of the bottom opening 24 may be able to accommodate the addition of small solids to the beverage, such as crushed ice, sugar cubes, cinnamon sticks, tapioca pearls, cocoa nibs, and/or tea leaves. Alternatively, the added ingredient may be a liquid including, but not limited to, flavored creamer, milk, milk substitute, half-and-half, cream, whey, water, sugar syrup, maple syrup, flavored syrup, honey, agave nectar, butter, coconut oil, espresso, and/or liquor. Alternatively, the added ingredient may be an emulsion such as foamed milk or whipped cream. In one embodiment, the removable lid 10 may be attached to an empty drinking cup 52, and a beverage 62 may be transferred into the cup entirely through the bottom opening 24. In a further embodiment, this transferring may be performed by an automated process, in which the shape of the ellipsoidal recession 22 is used to guide and position a nozzle into the bottom opening 24.

In one embodiment, the perimeter 26 of the bottom opening is connected to a baffle wall 28 that extends away from the top side 12. Preferably, the baffle wall 28 is configured to block a beverage 62 contained in the cup 52 from unintentionally entering the ellipsoidal recession 22 through the bottom opening 24 if the cup is moved suddenly. This may prevent a beverage 62 from splashing out of a cup 52 while the consumer is holding the cup and walking, standing in a moving environment such as a subway train, or when the cup is secured in a cup holder of a moving vehicle or shopping cart. However, any liquid that may splash into but not beyond the ellipsoidal recession 22 may be redirected to the bottom opening 24, as mentioned previously. When the level of the beverage beneath the lid is not moving, for example, when the cup is at rest on a table, the bottom edge 40 of the baffle wall may or may not contact the beverage.

The ratio of the maximum length of the baffle wall 28 to the maximum depth of the ellipsoidal recession 22 may be 1:10-10:1, preferably 1:5-5:1, more preferably 1:2-2:1. In one embodiment, the length of the baffle wall 28 does not change around the perimeter 26 of the bottom opening. However, in a preferred embodiment, as shown in the cross-section of FIG. 2, the length of the baffle wall 28 becomes shorter when moving on the perimeter 26 of the bottom opening in a direction away from the periphery 16 of the top side (meaning, towards the right side of FIG. 2). In another embodiment, the length of the baffle wall 28 may become greater when moving away from the periphery 16.

In one embodiment, the baffle wall 28 forms the sides of a cylinder, more specifically a generalized cylinder, which is defined here as a three-dimensional form having a curved, 2-dimensional shape as a first face (such as a circle, ellipse, epicycloid, oval, or a combination of curves as described for the shape of the periphery or bottom opening) with extended, parallel sides that connect to the perimeter of a second face. The baffle wall 28 may form the sides of a right cylinder, where the first and second faces are the same shape and in parallel planes, and the sides are perpendicular to both faces. In another embodiment, the baffle wall 28 may form the sides of an oblique cylinder, where the first and second faces are the same shape and in parallel planes, but the sides are not perpendicular to either face, for instance, the sides may be at an angle of 10°-30°, preferably 15°-25° off from the perpendicular. In another embodiment, the baffle wall 28 may form the sides of a truncated cylinder, where one face is perpendicular with the sides, and the other face is not perpendicular to the sides. In a preferred embodiment, the baffle wall 28 may form the sides of a truncated oblique cylinder, where neither of the faces are perpendicular to the sides, and the faces are furthermore not in parallel planes. A baffle wall 28 forming the sides of a truncated oblique cylinder is illustrated in FIG. 2. One face of the truncated oblique cylinder is defined by the perimeter 26 of the bottom opening, with the other face being defined by the edge 40 on the opposite end of the baffle wall. In one embodiment, as shown in FIG. 2, the edge 40 of the truncated oblique cylinder opposite the bottom opening 24 defines a plane that forms an angle of 5°-50°, preferably 7°-30°, more preferably 8°-20° with a plane circumscribed by the annular mounting portion 20. In another embodiment, this edge 40 of the truncated oblique cylinder may be substantially parallel with the top side 12. In another embodiment, also shown in FIG. 2, a central axis of the truncated oblique cylinder (i.e. the form made by the baffle wall) intersects a plane circumscribed by the annular mounting portion 20 at an angle of 60°-80°, preferably 65°-75°, more preferably 66°-74°. This plane may be defined by the bottom edge of a lid 10, for instance, the plane of a countertop on which a lid 10 is sitting with the same orientation as in FIG. 5, or some other parallel plane. In an alternative embodiment, the baffle wall 28 may have one or more planar sides, such as a prism. In another embodiment, the sides of the baffle wall may not be parallel with each other, for instance, the sides may form a conical section or a truncated pyramid, rather than the sides of a generalized cylinder.

In the embodiments where the baffle wall 28 has different lengths extending from the perimeter 26, the minimum length of those lengths may be 10-80%, preferably 20-75%, more preferably 25-75% of the maximum length. In another embodiment, the edge 40 of the baffle wall slants straight and downwards, away from the periphery 16. In an alternative embodiment, the baffle wall 28 is only connected to a portion of the perimeter 26, for instance, the half of the perimeter farthest away from the periphery 16. Similarly, in another embodiment, the baffle wall 28 may merge or connect with the sidewall 18. Alternatively, the baffle wall 28 may comprise holes or breaks around the perimeter 26, or the baffle wall 28 may be attached to a part of the annular mounting portion 20, the ellipsoidal recession 22, or some other part of the lid 10. In another alternative embodiment, more than one baffle wall 28 may be attached to the ellipsoidal recession 22 and may be spaced at different distances from the perimeter 26 and/or may have different lengths. In one alternative embodiment, a portion of the baffle wall 28 may be curved or angled towards or away from the perimeter 26 to reduce straight line paths of the beverage 62 through the bottom opening 24. Preferably, however, the baffle wall 28 and ellipsoidal recession 22 are shaped so that removable lids 10 may be nested with each other and stacked. Lids 10 that are nested may be more easily stored, packaged, and shipped, and nesting the lids together may protect the lids from deformation.

In one embodiment, the top side 12 is shaped (for example, with a depression) so that a second cup may be stacked on top without sliding off. In one embodiment, a depression on the top side 12 may have a curved and/or straight top edge and curved and/or straight interior sides, similar to the possible geometries of the ellipsoidal recession 22 as mentioned previously. The area enclosed by the top edge of the depression may be less than 80%, preferably less than 70%, more preferably less than 60% of the area enclosed by the periphery 16 of the top side. However, in one embodiment, the depression is circular and concentric with a circular periphery 16, thus creating a circular lip, with the ellipsoidal recession 22 positioned inside the depression. In one embodiment, the interior bottom of a depressed region in the top side may comprise one or more planar surfaces that slant down towards a drainage hole. The drainage hole may allow for liquid that has reached the top side 12 of the lid to return to the cup 52 interior. This drainage hole may have a diameter of 2.5 mm or less, preferably 2 mm or less, more preferably 1.5 mm or less. In an alternative embodiment, the depression and drainage hole may additionally serve as a funnel for adding a liquid ingredient to the beverage. In one embodiment, the drainage hole may also function as a vent hole.

In one embodiment, the top side 12 of the lid may comprise a vent hole 30, preferably located in a region of the top side opposite the ellipsoidal recession 22. For instance, this region may be the half of the surface of the top side that is located the farthest from the ellipsoidal recession 22. The vent hole 30 may be circular or some other shape and may have a longest dimension of 5 mm or less, preferably 4 mm or less, more preferably 3 mm or less. The vent hole 30 may improve the flow of a beverage out of the bottom opening 24 by providing an additional pathway for displacing air to enter through the lid 10. The top side 12 of the lid may additionally comprise a flap attached with a hinge or flexible element, and a surface of the flap may have a raised indentation configured to plug the vent hole 30 when the flap is in a closed position. Alternatively, the top side 12 of the lid may comprise a plug or a pin attached to string or a flexible arm, for the same purpose of plugging the vent hole 30. In an alternative embodiment, a vent hole 30 may exist in a part of the sidewall 18, beveled segment 48, curved segment 46, or liquid trough 36. A vent hole 30 in the liquid through 36 may also function as a drain. FIGS. 1B and 1C show a lid 10 having a vent hole 30, and FIG. 8 shows a lid 10 having two vent holes 30. In one embodiment, a vent hole 30 may be used for venting aroma to a consumer's nose while drinking. In this embodiment, a lid 10 may have a larger vent hole 30, or more than one vent hole 30.

In one embodiment, a central region 44 of the top side has a stirrer opening 32 to accommodate a stirring rod 54 traversing through the top side 12. The stirrer opening 32 may be circular with a diameter of 2-7 mm, preferably 3-6 mm. In a preferred embodiment, the stirrer opening 32 is elongated with a length to width ratio of 2:1-10:1, preferably 2.5:1-9:1, more preferably 3:1-8:1. This embodiment is shown in FIGS. 1A and 6A. An elongated stirrer opening 32 may have a rectangular or oval shape. In one embodiment, the removable lid 10 further comprises a stirring rod 54 traversing the lid at the stirrer opening. The stirrer opening 32 may have a cross-section area of at least 2%, preferably at least 5%, more preferably at least 7% greater than the cross-section area of a stirring rod at the point it traverses the top side 12. In another embodiment, the stirrer opening 32 may have one or more dimensions equal or slightly smaller than the cross-section area of a stirring rod 54, so that two or more sides of the stirrer opening 32 come into contact with the stirring rod 54. Preferably, in this embodiment, the lid 10, or at least the part that contains the stirrer opening 32, is made of a deformable material. In an alternative embodiment, a stirrer opening 32 may be a closed but frangible or perforated part of the top side 12, or a part of the top side that has one or more incisions. This type of stirrer opening 32 may be similar to those used on lids for disposable soft drink cups.

The stirring rod 54 may comprise any of the previously mentioned materials for lids and cups, or may comprise wood. The stirring rod 54 may be used through the stirrer opening 32, or alternatively, through the bottom opening 24. A stirring rod 54 may also be considered a coffee stirrer, a stir stick, a beverage stirrer, a straw, a stirring paddle, or a swizzle stick.

The total length of the stirring rod 54 may be one that allows for a stirring rod to protrude at least 5 mm, preferably at least 10 mm, more preferably at least 15 mm from the top side 12 of the lid when positioned vertically and touching the bottom of the cup interior. In the embodiment where the stirring rod 54 may be moveable at an angle, allowing it to touch a bottom corner or curve of the cup interior while traversing the top side 12 (similar to the orientation shown in FIG. 5), the total length of the stirring rod 54 may be one that allows it to protrude by at least 5 mm, preferably at least 10 mm, more preferably at least 15 mm from the top side 12 of the lid. Preferably, the stirring rod 54 is not so long as to contact the face of a consumer as he or she drinks through the lid 10. Advantageous stirring rod 54 lengths may depend on the dimensions of the cup interior. In one embodiment, the stirring rod 54 has a length of 3 cm-30 cm, preferably 6 cm-25 cm, more preferably 9 cm-20 cm. In an alternative embodiment, the stirring rod 54 may be positioned in a part of the top side 12 away from the ellipsoidal recession 22 to provide extra distance from a consumer's face. In an alternative embodiment, the stirring rod 54 may be telescoping or folding.

The cross-section of the stirring rod 54 may be circular, rectangular, or a different shape, such as a square cross, and may be hollow or solid. Preferably the cross-section is rectangular. The largest width of the stirring rod 54 where it traverses the top side 12 may be 2 mm-17 mm, preferably 2-10 mm, more preferably 3-9 mm. In one embodiment, a portion of the stirring rod 54 near the top side surface is cylindrical, with a circular cross-section, while the portion near and in the beverage 62 is flattened, with a rectangular cross-section. In one embodiment, the stirring rod 54 is hollow through its entire length, allowing it to also function as a straw. In one embodiment, the stirrer opening 32 is of the shape and is sufficiently large for the stirring rod 54 to be rotated and moved in three dimensions, for instance, within a certain range of angles from a central axis of the stirrer opening 32. In one embodiment, the stirring rod 54 movement may be restricted to rotation and vertical translation. In an alternative embodiment, the stirrer opening 32 may restrict the rotation of the stirring rod 54, but allow for its movement within a plane perpendicular to the top side 12 of the lid, for example, where a rectangular stirring rod 54 is inserted into a rectangular stirrer opening 32 (as in FIG. 5).

In one embodiment, where the top side 12 has a stirrer opening 32, the stirrer opening may have a sheath 50 extending from an edge of the stirrer opening and towards a plane circumscribed by the annular mounting portion 20. FIG. 1B shows a sheath 50 from a beverage side of the lid. The sheath 50 may form an angle of 70°-90°, preferably 74°-86°, more preferably 76°-84° with a plane circumscribed by the annular mounting portion 20. The sheath 50 may be substantially perpendicular with the top side 12, meaning that it forms an angle of 85°-90°, preferably 87°-90° with the top side 12. Preferably this angle is in an orientation where the sheath 50 points down in a direction that is underneath the ellipsoidal recession 22. This way, for a linear stirring rod 54 held within the sheath 50, the part of a stirring rod 54 above the top side 12 is angled away from a consumer's face when the consumer is drinking through the lid 10. FIG. 5 illustrates this configuration of a stirring rod 54 held by the sheath 50. Preferably the sheath 50 is attached to the stirrer opening 32 in a flexible and resilient manner, so that a stirring rod 54 going through the sheath 50 may be used to stir or agitate a beverage 62, and then the stirring rod may return to its original angle with the annular mounting portion 20, or a similar angle off by only 2°-7°, preferably 3°-5°. In one embodiment, the sheath 50 is made of a resilient or elastic material and one or more dimensions of the sheath are smaller than the stirring rod 54. Then, the stirring rod 54 may be held in place by the sheath 50, but easily movable within the sheath if a consumer pushes or pulls on the stirring rod 54. In one embodiment, the sheath 50 is formed closed or with its sides squeezed against each other, so that without a stirring rod 54 inserted, or with a stirring rod removed, the sheath prevents beverage 62 from going through the stirrer opening 32.

The stirring rod 54 may have identical ends as that in FIG. 5, though in one embodiment, the end below the lid is configured to better agitate a beverage when the top of the stirring rod is moved up and down, back and forth, at an angle, and/or rotated. As used herein, a stirring rod 54 configured to better agitate a beverage is defined as producing a greater turbulence, shear, flow, and/or mixing rate as compared to a stirring rod moved in a usual circular or rotating manner through a similar liquid having similar dimensions. A stirring rod 54 configured to better agitate a beverage may have a beverage end that is flattened, forked, or in a shape comprising a paddle, a spoon, a bulb, a whisk, a spring, an impeller, a blade, a hole, a slot, a brush, a ring, a screw, or some other shape. Preferably, more than one shape may be used.

In one embodiment, the surface of the stirring rod 54 above the top side 12 may comprise a flat shape, grooves, notches, or some other texture to facilitate a finger grip for rotation. In a preferred embodiment, the stirring rod 54 is attached perpendicularly to a disc above the top side 12 of the lid. The disc may be connected at a part of the stirring rod 54 so that the disc can sit on the top side while the bottom of the stirring rod is at least 5 mm, preferably at least 8 mm, more preferably at least 10 mm above the interior bottom of the cup 52. In one embodiment, the stirring rod 54 terminates at the disc, but alternatively the stirring rod may protrude above. The stirring rod 54 and the disc may be formed from a single piece of material. Alternatively, they may be formed separately and then attached, for example, by attaching the end of the stirring rod 54 to the disc or by pushing the stirring rod through a central hole in the disc. In another embodiment, the disc may be made of more than one type of material, for example, the perimeter of the disc may comprise an elastomeric material while the rest of the disc is non-elastic. Preferably the disc is circular, though in an alternative embodiment, other shapes may be used such as rectangular prisms, hemispheres, balls, or some other form. The disc may have a thickness of 2-12 mm, preferably 3-10 mm, more preferably 4-8 mm. The diameter of the disc may be 10-90%, preferably 20-60%, more preferably 25-50% of the largest diameter of the annular mounting portion 20. In the embodiment where the top side 12 has a depressed region, the disc may be located on a surface within the depressed region, or it may be located above and adjacent to the depressed region. Where the lid is traversed by a stirring rod with a disc, preferably the top side 12 of the lid is parallel with a plane circumscribed by the annular mounting portion 20, so that the plane of the bottom side of the disc is also parallel and the stirring rod 54 is perpendicular to the top side 12 of the lid. However, in an alternative embodiment, the stirring rod 54 is attached to the bottom of the disc by a flexible element, such as a string, a braid, a cable, a wire, a chain, or a universal joint, allowing the disc to sit on a tilted or non-parallel top side 12. The disc may comprise a hole, a groove, a notch, a handle, a ring, a tab, an indent, or some other shape to facilitate a finger grip for rotating the disc to stir or agitate a beverage 62. The disc may comprise two or more similar shapes arranged with rotational symmetry so that the consumer may grip the disc across its center and easily rotate it.

In one embodiment, the disc may be of a size and shape that allows it to cover a vent hole 30 in the top side 12 at certain angles of rotation. Similarly, in an alternative embodiment, the disc may sit in the same plane as the top edge 42 of the ellipsoidal recession, and have a sufficiently large hole or notch and a sufficiently large diameter so that it can cover and seal the entire ellipsoidal recession 22 at certain angles of rotation, while keeping it open and exposed at other angles. Such a feature may allow a consumer to choose between an open and closed configuration of the ellipsoidal recession 22. In one embodiment, a part of the stirring rod 54 on the beverage side of the lid 10 may comprise a second disc or some other shape to limit the stirring rod's vertical movement. In a further embodiment, the disc and/or the second disc or shape is removably attached to the stirring rod 54 in order for the stirring rod to be completely separated from the lid 10 for cleaning or assembly.

Figure 7:
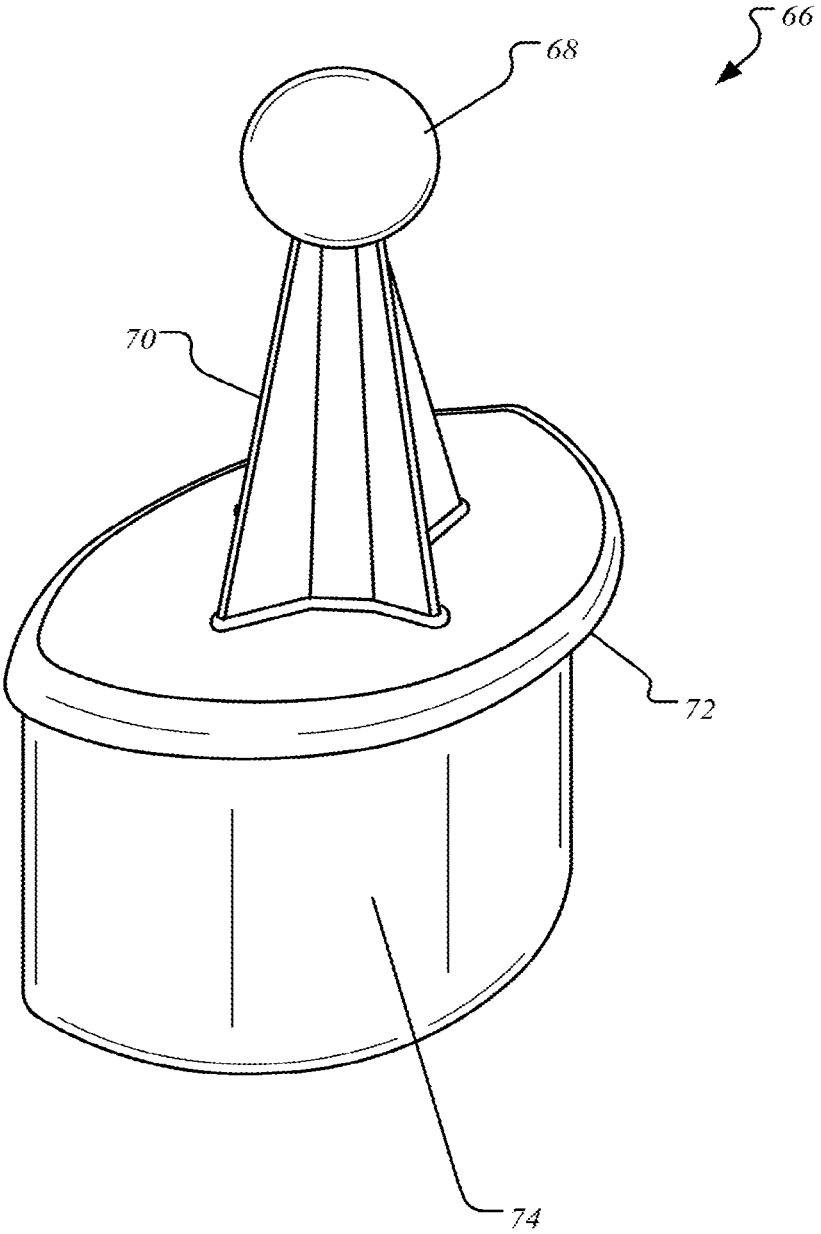
FIG. 7 is a blocking plug.

In one embodiment, the removable lid 10 further comprises a blocking plug 66 removably attached to the bottom opening 24 and configured to block a beverage 62 from traversing the bottom opening. One embodiment of a blocking plug 66 is shown in FIG. 7. Here, the blocking plug 66 has a handle 68 and shaft 70 connected to the insert 74. The handle 68 and shaft 70 together may have a length of 0.5-3 cm, preferably 0.8-2 cm, more preferably 1.0-1.5 cm, and may have widths of 0.2-1.5 cm, preferably 0.3-1.2 cm, more preferably 0.4-0.8 cm. The insert 74 may have a flange 72 in order to prevent the blocking plug 66 from going all the way through the bottom opening 24, and to also seal around the perimeter 26 of the bottom opening. This flange 72 may extend from the insert 74 by 1-5 mm, preferably 1.5-4 mm, more preferably 1.8-3.8 mm. The flange 72 may extend from an entire perimeter of the insert or only a part of a perimeter. Preferably the insert 74 is shaped with a cross-section similar to the bottom opening 24 or the baffle wall 28, however, in another embodiment, the cross-section may be smaller, and the insert 74 may be encircled with a gasket or similar structure that fits in and/or seals against the baffle wall 28. When the blocking plug 66 is placed into the bottom opening through the ellipsoidal recession 22, as shown in FIG. 8, for example, the insert 74 may extend 10%-100%, preferably 15%-80%, more preferably 20%-60% of the baffle wall length, though in some embodiments, the insert may extend beyond the baffle wall, for example, by 1-7 mm, or 2-5 mm. In one embodiment, a part of the blocking plug 66 may be shaped like all or a part of the ellipsoidal recession 22, and in this embodiment, a flange 72 may not be needed. In another embodiment, a flange 72 may not be necessary if the baffle wall 28 and/or insert 74 of the blocking plug are angled. In another embodiment, the blocking plug 66 may be connected to a string or tether, and may or may not have a handle 68. In another embodiment, the handle 68 and/or shaft 70 may be angled relative to the insert 74, so that the handle 68 and/or shaft 70 are vertical when the blocking plug 66 is placed in the bottom opening 24. Where the blocking plug 66 has a string or tether, the string or tether may be attached to a part of the removable lid 10. In another embodiment, a blocking plug 66 may be hingedly attached near the ellipsoidal recession 22. The blocking plug 66 may be made of any of the previously mentioned materials and may be solid or hollow, and may be designed to be disposable or reusable. More than one blocking plug 66 may be colored differently in order to distinguish removable lids enclosing different beverages. In an alternative embodiment, the blocking plug 66 may be incorporated with a stirring rod 54 or drinking straw. In another alternative embodiment, the baffle wall 28 and the blocking plug insert 74 may comprise complementary screw threads so that the blocking plug 66 may be secured by twisting. In one embodiment, a blocking plug 66 inserted into the bottom opening 24 of a lid 10, cup 52, and beverage 62 assembly is able to prevent leakage and resist the weight of a beverage when the cup is turned sideways or inverted.

In another embodiment, the bottom opening 24 may be blocked from the beverage side of the lid, for instance, from the bottom edge 40 of the baffle wall. This may be done by a blocking paddle connected to a central portion of a stirring rod 54. Here, a central portion of the stirring rod may refer to a central length spaced evenly between both ends that is 30% of the total length of the stirring rod 54. This blocking paddle may be a flat surface that has a raised insert to seal within the bottom edge 40 of the baffle wall to prevent beverage 62 from exiting the cup 52 through the bottom opening 24. The raised form may extrude 1-10 mm, preferably 2-8 mm, more preferably 3-6 mm above the flange, however, in one embodiment, the blocking paddle may not have a raised form. The blocking paddle may be connected to the stirring rod at a height that places the blocking paddle 20 mm or less, preferably 15 mm or less, more preferably 12 mm or less within the bottom edge 40 of the baffle wall. Preferably the blocking paddle and stirring rod 54 are configured so that the stirring rod may be rotated to position the blocking paddle underneath the baffle wall 28, and then the stirring rod 54 may be pulled up to seal the bottom edge 40 of the baffle wall with the blocking paddle. Preferably this seal may prevent a beverage 62 from exiting through the bottom opening 24 when the cup, lid, and beverage assembly is turned sideways or upside-down, or if the cup is dropped. Preferably the stirring rod 54 may be pushed back towards the beverage 54 to unblock the bottom opening 24. The arm connecting the blocking paddle to the stirring rod may be a linear segment and may intersect the stirring rod at a 90° angle, or may be angled upwards, forming an angle 10°-80°, preferably 20°-70°, more preferably 25°-65° with the stirring rod. The arm may be further reinforced by a web or bracket. In an alternative embodiment, the arm may be angled upwards, downwards, or perpendicularly with a second arm as a cross brace. In another alternative embodiment, the arm may be attached to the stirring rod 54 closer to the bottom of the cup 52, so that twisting the stirring rod allows the arm to agitate the beverage 62. In one embodiment, the stirring rod 54 and the blocking paddle may be formed from the same piece of material, though in another embodiment, the blocking paddle may be formed from a separate piece of material and removably attached to the stirring rod.

In one embodiment, a stirring rod 54 with a blocking paddle also has a disc above the top side 12 with a marking or design to indicate the location of the blocking paddle. For example, the rotational angle of the stirring rod 54 used to block the bottom opening 24 may also allow a portion of the disc to cover a vent hole 30 in the top side 12 of the lid. Preferably, the disc may have a notch, a label, a raised arrow, or some other feature for a consumer to identify the correct orientation.

In an alternative embodiment, a cup lid 10 may not have an ellipsoidal recession 22, but instead a drink opening in the same plane as the top side 12 of the lid. The drink opening may have a bottom opening 24 also in the same plane, or the drink opening may have a bottom edge 40 along a baffle wall, similar to what has been described previously. However, the cup lid 10 may have a stirring rod 54 traversing and freely rotatable within a central region 44 of the top side, and this stirring rod 54 may have a stirring paddle connected to its stirring end, and a blocking paddle connected from its central portion. The blocking mechanism may work as described previously, where the stirring rod 54 is rotated to line up the blocking paddle with the bottom edge, and then pulled in a direction away from the beverage 62 in order to seal the blocking paddle inside the bottom edge 40. As mentioned previously, the blocking paddle may have a raised form that fits within the bottom edge 40. The stirring rod 54 above the top side 12 of the lid may or may not comprise a disc, but preferably the stirring rod comprises a bulb, a ring, or some other shape to facilitate turning and pulling the stirring rod. Preferably the shape of the stirring rod 54 above the top side 12 has an indication on where to rotate the stirring rod to line up the blocking paddle with the bottom edge 40 or the drink opening. As described previously, this indication may be a notch, a label, a raised arrow, or some other form. Where the cup lid 10 has the blocking paddle actively sealing the drink opening, preferably the stirring rod 54 may be pressed towards the beverage 62 to unblock the drink opening. In an alternative embodiment, as described previously, the stirring rod 54 may not have a stirring paddle connected to its stirring end, but instead the blocking paddle and/or the arm connecting the blocking paddle is able to agitate the beverage 62 when the stirring rod 54 is rotated. In an alternative embodiment, the stirring rod 54 may have a paddle that fits into the bottom opening 24 as described for the blocking paddle, but instead, the paddle has a mesh or a porous surface. This porous surface, when fit into the bottom opening 24 or the bottom edge 40 of the baffle wall, may allow a beverage to be strained of tea leaves, ice cubes, or other solids, while being consumed. A stirring rod 54 with such porous paddle may also include a blocking paddle, preferably on opposite sides.

Stirring rods 54 that include blocking paddles may rotate freely when a lid and cup assembly is tilted. Depending on the friction of the stirring rod 54 with the stirrer opening 32 and the density of the blocking paddle, the blocking paddle may rotate underneath the bottom edge 40 and impede the flow of beverage to a consumer. One way to prevent this unintentional rotation may be to include a second blocking paddle, identical to the first, in order to balance the torque on the stirring rod 54. Another way may be to include a catch in the lid for the stirring rod 54 to be held in a drinking position. This catch may be a movable tab or flap attached to the top side 12 of the lid that engages and locks the disc in a certain position. Furthermore, this movable tab or flap may also unblock a vent hole 30 in the lid when it holds the disc in a drinking position. Alternatively, the beverage side of the lid may have a hook or a slot for the blocking paddle to be rotated to and held within. Alternatively, the portion of the stirring rod 54 below the central region 44 of the top side may have a wider diameter, so that pulling the stirring rod away from the beverage 62, with the blocking paddle in a closed or an open position, provides a frictional coupling between the stirring rod and the stirrer opening 32 that prevents unintentional rotation.

The invention claimed is:

1. A removable lid for a drinking cup, the removable lid comprising:

a top side with a substantially circular periphery;

a sidewall extending from the periphery;

an annular mounting portion extending from an edge of the sidewall and configured to removably attach to an open side of a drinking cup; and an ellipsoidal recession, located adjacent to the periphery of the top side, with a bottom opening, and a baffle wall connected along a perimeter of the bottom opening and extending away from the top side, wherein the baffle wall is configured to block a beverage from passing through the bottom opening and into the ellipsoidal recession upon a sudden movement of the beverage, and wherein the baffle wall comprises holes, and slants straight and downwards away from the periphery of the top side, wherein an intersection of the ellipsoidal recession and the top side forms a generally elliptical shape having a long axis to short axis length ratio of 1.5:1-1.9:1 and wherein the short axis is aligned towards a central region of the top side, wherein the ellipsoidal recession is configured to collect the beverage from the bottom opening prior to consumption, allow an ingredient to pass through the bottom opening to the beverage, or both, and wherein the top side is a generally planar surface foil ling an angle of 4°-15° with a plane circumscribed by the annular mounting portion so that a height of the sidewall decreases as a distance from the ellipsoidal recession increases along a diameter of the lid.

2. The removable lid of claim 1, wherein the baffle wall forms the sides of a truncated oblique cylinder.

3. The removable lid of claim 2, wherein a central axis of the truncated oblique cylinder intersects a plane circumscribed by the annular mounting portion at an angle of 60°-80°.

4. The removable lid of claim 2, wherein an edge of the truncated oblique cylinder opposite the bottom opening defines a plane that forms an angle of 5°-50° with a plane circumscribed by the annular mounting portion.

5. The removable lid of claim 1, wherein the top side has a generally elliptical periphery with a length to width ratio of 1.03:1-1.10:1.

6. The removable lid of claim 1, wherein the sidewall has a concave curvature near the ellipsoidal recession.

7. The removable lid of claim 1, further comprising a curved segment, a beveled segment, or both, between the sidewall and the periphery.

8. The removable lid of claim 1, wherein a central region of the top side has a stirrer opening within a plane of the top side to accommodate a stirring rod.

9. The removable lid of claim 8, further comprising a sheath extending from an edge of the stirrer opening, the sheath forming an angle of 70°-90° with a plane circumscribed by the annular mounting portion.

10. The removable lid of claim 8, wherein the stirrer opening is elongated along a direction on the top side with a length to width ratio of 2:1-10:1.

11. The removable lid of claim 1, wherein the annular mounting portion comprises a bead and a skirt.

12. The removable lid of claim 11, wherein the skirt is grooved, with grooves extending away from the top side.

13. The removable lid of claim 11, wherein the annular mounting portion further comprises a liquid trough located between the bead and the sidewall.

14. The removable lid of claim 1, wherein the bottom opening comprises a first edge along the perimeter with a first radius of curvature and a second edge along the perimeter with a second radius of curvature, wherein a ratio of the first radius to the second radius is 1:1.1-1:2.5, and wherein the first edge of the bottom opening is closest to a central region of the top side.

15. The removable lid of claim 1, further comprising:

a vent hole in a region of the top side opposite the ellipsoidal recession.

16. The removable lid of claim 1, wherein the top side has a corrugated surface, the corrugated surface having a plurality of corrugations arranged radially.

17. The removable lid of claim 1, further comprising a blocking plug removably attached to the bottom opening, the blocking plug having a handle and is configured to block the beverage from traversing the bottom opening.

* * * * *